US012209782B2

(12) United States Patent
Satou et al.

(10) Patent No.: US 12,209,782 B2
(45) Date of Patent: Jan. 28, 2025

(54) ABNORMALITY DETERMINATION DEVICE, FREEZING DEVICE INCLUDING THIS ABNORMALITY DETERMINATION DEVICE, AND ABNORMALITY DETERMINATION METHOD FOR COMPRESSOR

(71) Applicant: DAIKIN INDUSTRIES, LTD., Osaka (JP)

(72) Inventors: Kiichirou Satou, Osaka (JP); Masataka Nakano, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 570 days.

(21) Appl. No.: 17/278,703

(22) PCT Filed: Sep. 26, 2019

(86) PCT No.: PCT/JP2019/037873
§ 371 (c)(1),
(2) Date: Mar. 23, 2021

(87) PCT Pub. No.: WO2020/067295
PCT Pub. Date: Apr. 2, 2020

(65) Prior Publication Data

US 2022/0042730 A1 Feb. 10, 2022

(30) Foreign Application Priority Data

Sep. 28, 2018 (JP) ..... 2018-184238

(51) Int. Cl.
*F25B 49/02* (2006.01)

(52) U.S. Cl.
CPC ..... *F25B 49/02* (2013.01); *F25B 2500/19* (2013.01); *F25B 2700/151* (2013.01);
(Continued)

(58) Field of Classification Search
CPC ..... F25B 49/02; F25B 2500/19
See application file for complete search history.

(56) References Cited

U.S. PATENT DOCUMENTS 5,249,429 A * 10/1993 Hanson ..... F25D 11/003 62/133
10,767,507 B2 * 9/2020 Khibnik ..... F01D 21/003
(Continued)

FOREIGN PATENT DOCUMENTS

JP 5-272849 A 10/1993
JP 2003-161495 A 6/2003
(Continued)

OTHER PUBLICATIONS

English translation of the International Search Report for International Application No. PCT/JP2019/037873, dated Nov. 26, 2019.
(Continued)

*Primary Examiner* — Henry T Crenshaw
(74) *Attorney, Agent, or Firm* — Birch, Stewart, Kolasch & Birch, LLP

(57) ABSTRACT

An abnormality determination device (60) includes a calculator (66) calculating a deviation degree of a compressor (11) from a normal state based on data related to operation of a refrigeration apparatus (1) and a determination unit (62) determining whether the compressor (11) has an abnormality or estimating an abnormality occurrence time based on a calculation result of the calculator (66). The calculator (66) calculates a first index value from data related to operation of the refrigeration apparatus (1) in a first period and a second index value from data related to operation of the refrigeration apparatus (1) in a second period that differs in length from the first period. The calculator (66) calculates the deviation degree of the compressor (11) from the normal state based on the first index value and the second index value. The determination unit (62) determines whether the
(Continued)

compressor (11) has an abnormality or estimates an abnormality occurrence time based on the deviation degree of the compressor (11) from the normal state.

18 Claims, 9 Drawing Sheets

(52) U.S. Cl.
CPC . *F25B 2700/171* (2013.01); *F25B 2700/1931* (2013.01); *F25B 2700/1933* (2013.01); *F25B 2700/21151* (2013.01); *F25B 2700/21152* (2013.01); *F25B 2700/2116* (2013.01); *F25B 2700/2117* (2013.01)

(56) References Cited

U.S. PATENT DOCUMENTS

2002/0138619 A1* 9/2002 Ramaley ..... H04L 65/1101 709/217
2006/0136175 A1 6/2006 Suzuki et al.
2007/0089440 A1* 4/2007 Singh ..... F25B 49/005 62/228.3
2015/0142338 A1* 5/2015 Nakano ..... F02D 41/222 702/35
2016/0349293 A1* 12/2016 Chattopadhyay .... G01R 21/006
2017/0264566 A1* 9/2017 Namboodiri ..... H04L 47/803
2019/0003734 A1* 1/2019 Costa ..... F24F 11/38

FOREIGN PATENT DOCUMENTS

JP 2003-214735 A 7/2003
JP 2006-64307 A 3/2006
JP 2007-225158 A 9/2007
JP 2009 002650 * 1/2009
JP 2009-2650 A 1/2009
JP 2010-127568 A 6/2010
JP 2014-98515 A 5/2014
JP 2015-222151 A 12/2015

OTHER PUBLICATIONS

English translation of the International Preliminary Report on Patentability and Written Opinion of the International Searching Authority for International Application No. PCT/JP2019/037873, dated Mar. 23, 2021.
Extended European Search Report for EP Application No. 19866908.7, dated Oct. 4, 2021.

* cited by examiner

ABNORMALITY DETERMINATION DEVICE, FREEZING DEVICE INCLUDING THIS ABNORMALITY DETERMINATION DEVICE, AND ABNORMALITY DETERMINATION METHOD FOR COMPRESSOR

TECHNICAL FIELD

The present disclosure relates to an abnormality determination device, a refrigeration apparatus including the abnormality determination device, and a method for determining an abnormality of a compressor.

BACKGROUND ART

A typical refrigeration cycle apparatus includes a refrigerant circuit including a compressor, a condenser, a metering device, and an evaporator so that a refrigerant circulates in the refrigerant circuit. The refrigeration cycle apparatus has a configuration that determines deterioration of the compressor (refer to, for example, Patent Document 1). In such a refrigeration cycle apparatus, deterioration of the compressor is determined by comparing an operation state amount (determination threshold value) obtained under a predetermined refrigeration condition when the refrigeration cycle apparatus is initially installed (reference time) with an operation state amount (determination index) under the same refrigeration condition as the reference time when a predetermined period has elapsed from the installation.

PRIOR ART DOCUMENT

Patent Document

Patent Document 1: Japanese Laid-Open Patent Publication No. 2014-98515

SUMMARY OF THE INVENTION

Problems that the Invention is to Solve

In the typical refrigeration cycle apparatus, to determine deterioration of the compressor, the refrigerant condition of the initial installation (reference time) needs to conform to the refrigerant condition when the predetermined period has elapsed from the installation. Therefore, a special operation for determining deterioration of the compressor needs to be performed. In this configuration, a normal cooling operation cannot be performed during determination of deterioration of the compressor.

It is an object of the present disclosure to provide an abnormality determination device, a refrigeration apparatus including the abnormality determination device, and a method for determining an abnormality of a compressor that dispense with a special operation for determining an abnormality of the compressor.

Means for Solving the Problems

According to the present disclosure, an abnormality determination device determines an abnormality of a compressor of a refrigeration apparatus. The refrigeration apparatus includes a refrigerant circuit. The refrigerant circuit includes the compressor, a condenser, and an evaporator and is configured so that a refrigerant circulates through the compressor, the condenser, and the evaporator. The abnormality determination device includes a calculator and a determination unit. The calculator calculates a deviation degree of the compressor from a normal state based on data related to operation of the refrigeration apparatus. The determination unit determines whether the compressor has an abnormality or estimates an abnormality occurrence time based on a calculation result of the calculator. The data related to operation of the refrigeration apparatus include data related to operation of the refrigeration apparatus in a first period and data related to operation of the refrigeration apparatus in a second period that differs in length from the first period. The calculator is configured to calculate a first index value from the data related to operation of the refrigeration apparatus in the first period and calculate a second index value from the data related to operation of the refrigeration apparatus in the second period. The calculator is configured to calculate the deviation degree of the compressor from the normal state based on the first index value and the second index value. The determination unit is configured to determine whether the compressor has an abnormality or estimate an abnormality occurrence time based on the deviation degree of the compressor from the normal state.

With this configuration, the deviation degree of the compressor from the normal state is calculated based on the deviation degree between the first index value and the second index value that are calculated using data related to operation of the refrigeration apparatus including operation in the pre-trip inspection of the refrigeration apparatus and normal operations of the refrigeration apparatus. This allows for determination of whether the compressor has an abnormality or estimation of an abnormality occurrence time. The data related to operation of the refrigeration apparatus is obtained from, for example, operation including normal operations of the refrigeration apparatus and operation in the pre-trip inspection of the refrigeration apparatus. With this configuration, without performing a special operation for determining an abnormality of the compressor, whether the compressor has an abnormality is determined or an abnormality occurrence time is estimated.

According to the present disclosure, an abnormality determination method determines an abnormality of a compressor of a refrigeration apparatus. The refrigeration apparatus including a refrigerant circuit. The refrigerant circuit includes the compressor, a condenser, and an evaporator and is configured so that a refrigerant circulates through the compressor, the condenser, and the evaporator. The method includes storing data related to operation of the refrigeration apparatus. The method further includes calculating a first index value from data related to operation of the refrigeration apparatus in a first period and calculating a second index value from data related to operation of the refrigeration apparatus in a second period that differs in length from the first period. The method further includes calculating a deviation degree of the compressor from a normal state based on the first index value and the second index value. The method further includes determining whether the compressor has an abnormality or estimating an abnormality occurrence time based on the calculated deviation degree of the compressor from the normal state.

With this configuration, the deviation degree of the compressor from the normal state is calculated based on the deviation degree between the first index value and the second index value that are calculated using data related to operation of the refrigeration apparatus including operation in the pre-trip inspection of the refrigeration apparatus and normal operations of the refrigeration apparatus. This allows for determination of whether the compressor has an abnormality or estimation of an abnormality occurrence time. The data related to operation of the refrigeration apparatus is obtained from, for example, operation including normal operations of the refrigeration apparatus and operation in the pre-trip inspection of the refrigeration apparatus. With this configuration, without performing a special operation for determining an abnormality of the compressor, whether the compressor has an abnormality is determined or an abnormality occurrence time is estimated.

MODES FOR CARRYING OUT THE INVENTION

A transporting refrigeration apparatus, which is an example of a refrigeration apparatus (hereafter, simply referred to as "refrigeration apparatus 1"), will be described below with reference to the drawings. The refrigeration apparatus 1 is configured to refrigerate the inside of storage, for example, a shipping container or a road transportation trailer container. The inside of a casing of the refrigeration apparatus 1 is divided into an interior accommodation space that circulates the air in the storage and an exterior accommodation space that circulates the air outside the storage.

Figure 1:
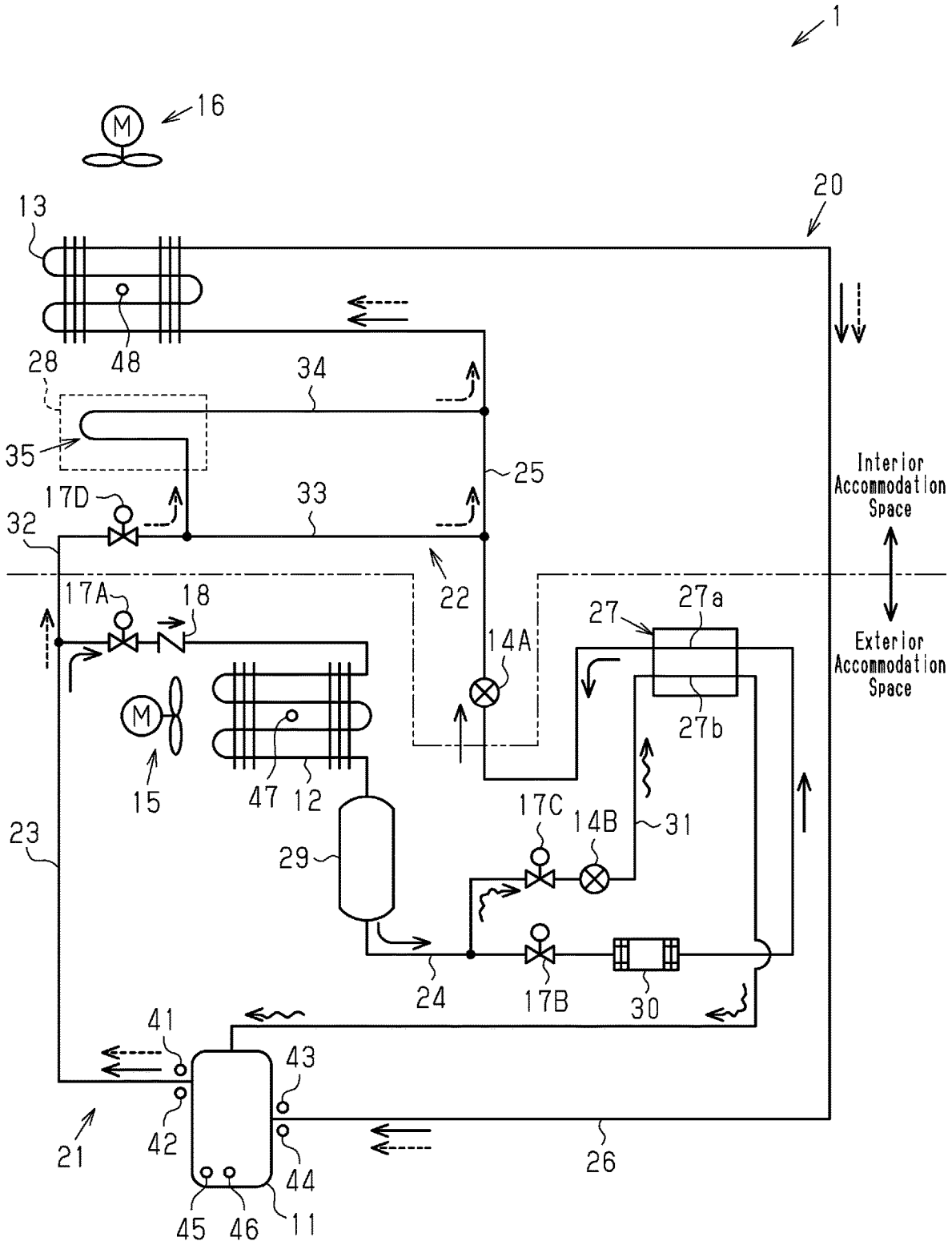
FIG. 1 is a conceptual diagram showing the present embodiment of a refrigeration apparatus.

As shown in FIG. 1, the refrigeration apparatus 1 includes a refrigerant circuit 20 in which, for example, a compressor 11, a condenser 12, and an evaporator 13 are connected by a refrigerant pipe. The refrigerant circuit 20 includes a main circuit 21, a hot gas bypass circuit 22, and a liquid refrigerant bypass circuit 31.

In the main circuit 21, the compressor 11 that is motor-driven, the condenser 12, a first expansion valve 14A, and the evaporator 13 are sequentially connected in series by the refrigerant pipe.

As shown in FIG. 1, the exterior accommodation space accommodates the compressor 11, the condenser 12, the first expansion valve 14A, and an exterior fan 15 that circulates the air outside the storage to the condenser 12. The interior accommodation space accommodates the evaporator 13 and an interior fan 16 that circulates the air in the storage to the evaporator 13.

The compressor 11 may be, for example, a rotary compressor or a scroll compressor. The compressor 11 is configured so that the operating capacity is variable when an inverter controls the operating frequency to control the rotational speed.

The condenser 12 and the evaporator 13 may be a fin-and-tube heat exchanger. The condenser 12 exchanges heat between the air outside the storage supplied by the exterior fan 15 and the refrigerant circulating in the condenser 12. The evaporator 13 exchanges heat between the air in the storage supplied by the interior fan 16 and the refrigerant circulating in the evaporator 13. An example of the exterior fan 15 and the interior fan 16 is a propeller fan. A drain pan 28 is disposed below the evaporator 13. The drain pan 28 collects, for example, frost and ice blocks falling from the evaporator 13 and water condensed from the air.

The first expansion valve 14A may be, for example, an electric expansion valve having an opening degree that is variable using a pulse motor.

The compressor 11 and the condenser 12 are connected by a high pressure gas pipe 23 that includes a first opening-closing valve 17A and a check valve 18 sequentially arranged in a direction in which the refrigerant flows. The first opening-closing valve 17A may be, for example, an electric expansion valve having an opening degree that is variable using a pulse motor. The check valve 18 allows the refrigerant to flow in directions of arrows shown in FIG. 1.

The condenser 12 and the first expansion valve 14A are connected by a high pressure liquid pipe 24 that includes a receiver 29, a second opening-closing valve 17B, a dryer 30, and a supercooling heat exchanger 27 sequentially arranged in the direction in which the refrigerant flows. The second opening-closing valve 17B may be, for example, an electromagnetic valve capable of opening and closing.

The supercooling heat exchanger 27 includes a primary passage 27*a* and a secondary passage 27*b* configured to exchange heat with each other. The primary passage 27*a* is disposed in the main circuit 21 between the dryer 30 and the first expansion valve 14A. The secondary passage 27*b* is disposed in the liquid refrigerant bypass circuit 31. The liquid refrigerant bypass circuit 31 is a bypass circuit that connects the high pressure liquid pipe 24 and an intermediate-pressure portion (not shown) of a compression mechanism of the compressor 11. A third opening-closing valve 17C and a second expansion valve 14B are sequentially connected, in the direction in which the high pressure liquid refrigerant flows, to the liquid refrigerant bypass circuit 31 between the high pressure liquid pipe 24 and the secondary passage 27*b*. In this configuration, when the liquid refrigerant flows into the liquid refrigerant bypass circuit 31 from the high pressure liquid pipe 24, the second expansion valve 14B expands the liquid refrigerant to an intermediate pressure, so that the liquid refrigerant has a lower temperature than the liquid refrigerant flowing through the high pressure liquid pipe 24 and flows to the secondary passage 27*b*. Thus, the high pressure liquid refrigerant flowing through the primary passage 27*a* is supercooled by the refrigerant flowing through the secondary passage 27*b*. The third opening-closing valve 17C may be, for example, an electromagnetic valve capable of opening and closing. The second expansion valve 14B may be, for example, an electric expansion valve having an opening degree that is variable using a pulse motor.

The hot gas bypass circuit 22 connects the high pressure gas pipe 23 and the inlet side of the evaporator 13 and sends the high-pressure high-temperature gas refrigerant discharged from the compressor 11 to the inlet side of the evaporator 13. The hot gas bypass circuit 22 includes a main passage 32, and a first branch passage 33 and a second branch passage 34 divided from the main passage 32. The first branch passage 33 and the second branch passage 34 are configured to be a parallel circuit in which one end of each of the first branch passage 33 and the second branch passage 34 is connected to the main passage 32 and the other end is connected to the inlet side of the evaporator 13, that is, a low pressure connection pipe 25 that extends between the first expansion valve 14A and the evaporator 13. The main passage 32 includes a fourth opening-closing valve 17D. The fourth opening-closing valve 17D may be, for example, an electromagnetic valve capable of opening and closing. The first branch passage 33 includes only a pipe. The second branch passage 34 includes a drain pan heater 35. The drain pan heater 35 is disposed at the bottom of the drain pan 28 to heat the drain pan 28 with the refrigerant having a high temperature.

Figure 2:
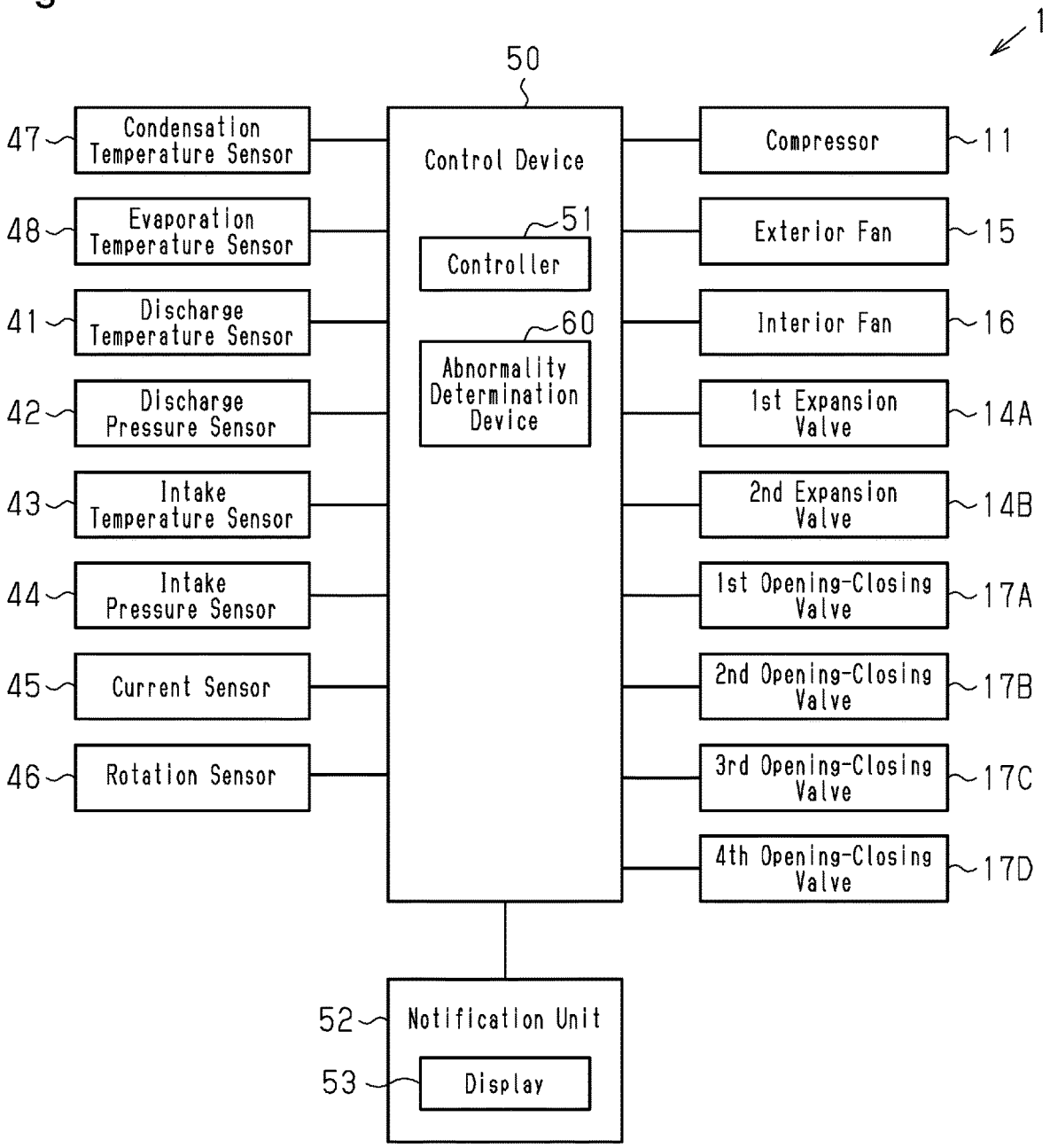
FIG. 2 is a block diagram showing electrical configurations of the refrigeration apparatus.

The refrigeration apparatus 1 includes various sensors. In an example, as shown in FIGS. 1 and 2, the refrigeration apparatus 1 includes a discharge temperature sensor 41, a discharge pressure sensor 42, an intake temperature sensor 43, an intake pressure sensor 44, a current sensor 45, a rotation sensor 46, a condensation temperature sensor 47, and an evaporation temperature sensor 48. The sensors 41 to 48 may be, for example, known sensors.

The discharge temperature sensor 41 and the discharge pressure sensor 42 are arranged, for example, on the high pressure gas pipe 23 in the vicinity of a discharge port of the compressor 11. The discharge temperature sensor 41 outputs a signal corresponding to the temperature of a discharge gas refrigerant discharged from the compressor 11. The discharge pressure sensor 42 outputs a signal corresponding to the pressure of the discharge gas refrigerant discharged from the compressor 11. The intake temperature sensor 43 and the intake pressure sensor 44 are arranged, for example, on an intake pipe of the compressor 11, that is, a low pressure gas pipe 26 in the vicinity of the intake port of the compressor 11. The intake temperature sensor 43 outputs a signal corresponding to the temperature of an intake gas refrigerant drawn into the compressor 11. The intake pressure sensor 44 outputs a signal corresponding to the pressure of the intake gas refrigerant drawn into the compressor 11. The current sensor 45 is arranged, for example, on an inverter circuit (inverter) that drives the motor of the compressor 11. The current sensor 45 outputs a signal corresponding to the amount of current flowing to the inverter circuit (inverter). The rotation sensor 46 is arranged, for example, on the motor of the compressor 11. The rotation sensor 46 outputs a signal corresponding to the rotational speed of the motor.

The condensation temperature sensor 47 is arranged, for example, on the condenser 12 and outputs a signal corresponding to the condensation temperature of the refrigerant flowing through the condenser 12. In the present embodiment, the condensation temperature sensor 47 is attached to, for example, an intermediate portion of the condenser 12. In this case, the condensation temperature sensor 47 obtains the temperature of the refrigerant in the intermediate portion of the condenser 12 as the condensation temperature and outputs a signal corresponding to the condensation temperature. The attachment position of the condensation temperature sensor 47 to the condenser 12 may be changed in any manner.

The evaporation temperature sensor 48 is arranged, for example, on the evaporator 13 and outputs a signal corresponding to the evaporation temperature of the refrigerant flowing through the evaporator 13. In the present embodiment, the evaporation temperature sensor 48 is attached to, for example, an intermediate portion of the evaporator 13. In this case, the evaporation temperature sensor 48 obtains the temperature of the refrigerant in the intermediate portion of the evaporator 13 as the evaporation temperature and outputs a signal corresponding to the evaporation temperature. The attachment position of the evaporation temperature sensor 48 to the evaporator 13 may be changed in any manner.

As shown in FIG. 2, the refrigeration apparatus 1 includes a notification unit 52 and a control device 50 that controls operation of the refrigeration apparatus 1. The control device 50 is electrically connected to each of the discharge temperature sensor 41, the discharge pressure sensor 42, the intake temperature sensor 43, the intake pressure sensor 44, the current sensor 45, the rotation sensor 46, the condensation temperature sensor 47, and the evaporation temperature sensor 48. The control device 50 is also electrically connected to the compressor 11, the first expansion valve 14A, the second expansion valve 14B, the exterior fan 15, the interior fan 16, the first opening-closing valve 17A, the second opening-closing valve 17B, the third opening-closing valve 17C, the fourth opening-closing valve 17D, and the notification unit 52. The notification unit 52 notifies information related to the refrigeration apparatus 1 to the outside of the refrigeration apparatus 1. The notification unit 52 includes, for example, a display 53 that shows information related to the refrigeration apparatus 1. The notification unit 52 may include a speaker instead of or in addition to the display 53. In this case, the notification unit 52 may issue notification of information related to the refrigeration apparatus 1 with sound.

The control device 50 includes a controller 51. The controller 51 includes, for example, an arithmetic unit that executes a predetermined control program and a storage unit. The arithmetic unit includes, for example, a central processing unit (CPU) or a micro processing unit (MPU). The storage unit stores various control programs and information used for various control processes. The storage unit includes, for example, nonvolatile memory and volatile memory. The controller 51 controls the compressor 11, the expansion valves 14A and 14B, the exterior fan 15, the interior fan 16, and the opening-closing valves 17A to 17D based on detection results of the sensors 41 to 48. The refrigeration apparatus 1 performs a refrigerating-cooling operation and a defrosting operation using the controller 51.

Refrigerating-Cooling Operation

In the refrigerating-cooling operation, the first opening-closing valve 17A, the second opening-closing valve 17B, and the third opening-closing valve 17C are open, and the fourth opening-closing valve 17D is closed. The opening degree of each of the first expansion valve 14A and the second expansion valve 14B is appropriately adjusted. Also, the compressor 11, the exterior fan 15, and the interior fan 16 are operated.

During the refrigerating-cooling operation, the refrigerant circulates as indicated by the solid arrows shown in FIG. 1. More specifically, a high-pressure gas refrigerant compressed in the compressor 11 is condensed to become a liquid refrigerant in the condenser 12 and then is stored in the receiver 29. The liquid refrigerant stored in the receiver 29 flows through the second opening-closing valve 17B and the dryer 30. The liquid refrigerant is supercooled to become a supercooled liquid refrigerant in the primary passage 27*a* of the supercooling heat exchanger 27 and flows to the first expansion valve 14A. As indicated by the wave arrows shown in FIG. 1, some of the liquid refrigerant discharged from the receiver 29 flows as a supercooling source through the third opening-closing valve 17C and the second expansion valve 14B to become an intermediate-pressure refrigerant. The intermediate-pressure refrigerant flows to the secondary passage 27*b* of the supercooling heat exchanger 27 to cool the liquid refrigerant in the primary passage 27*a*. The liquid refrigerant supercooled in the supercooling heat exchanger 27 is decompressed in the first expansion valve 14A and then flows to the evaporator 13. In the evaporator 13, a low-pressure liquid refrigerant absorbs heat from the air in the storage and evaporates. As a result, the air in the storage is cooled. The low-pressure gas refrigerant evaporated in the evaporator 13 is drawn into the compressor 11 and compressed again.

Defrosting Operation

When the refrigerating-cooling operation is continuously performed, frost collects on a surface of, for example, a heat transfer tube of the evaporator 13. The frost gradually develops and enlarges. The controller 51 performs the defrosting operation, that is, an operation for defrosting the evaporator 13.

As indicted by the broken arrows shown in FIG. 1, the defrosting operation allows a high-temperature high-pressure gas refrigerant that is compressed in the compressor 11 to flow to the inlet side of the evaporator 13 through a bypass to defrost the evaporator 13. In the defrosting operation, the fourth opening-closing valve 17D is open, and the first opening-closing valve 17A, the second opening-closing valve 17B, the third opening-closing valve 17C, and the second expansion valve 14B are fully closed. While the compressor 11 is operated, the exterior fan 15 and the interior fan 16 are stopped.

The high-pressure high-temperature gas refrigerant compressed in the compressor 11 flows through the main passage 32 and then the fourth opening-closing valve 17D and is divided into the first branch passage 33 and the second branch passage 34. The refrigerant divided into the second branch passage 34 flows through the drain pan heater 35. The refrigerant discharged from the drain pan heater 35 joins the refrigerant that has passed through the first branch passage 33 and flows to the evaporator 13. In the evaporator 13, a high-pressure gas refrigerant (so-called hot gas) flows in the heat transfer tube. Thus, in the evaporator 13, the frost collected on the heat transfer tube and a fin is gradually heated by the high-temperature gas refrigerant. As a result, the drain pan 28 gradually receives the frost from the evaporator 13. The refrigerant used to defrost the evaporator 13 is drawn into the compressor 11 and compressed again. The drain pan 28 receives, for example, an ice block that falls from the surface of the evaporator 13 in addition to water, that is, melted frost. The ice block is heated and melted by the refrigerant flowing in the drain pan heater 35. The melted water is discharged out of the storage through a predetermined flow passage.

As shown in FIG. 2, the control device 50 further includes an abnormality determination device 60 that determines whether the compressor 11 has an abnormality or estimates an abnormality occurrence time of the compressor 11. The abnormality of the compressor 11 includes a decrease in the compression efficiency of the compressor 11 caused by the refrigerant leak from the compression mechanism of the compressor 11 and an increase in the supply of current to the compressor 11 caused by a damaged bearing of the compressor 11 due to aging and deterioration. The abnormality determination device 60 monitors a polytropic index of the compressor 11 to determine whether the compressor 11 has an abnormality caused by an excessive decrease in the compression efficiency of the compressor 11. The abnormality determination device 60 monitors the supply of current to the compressor 11 to determine whether the compressor 11 has an abnormality. The abnormality determination device 60 estimates a time at which an abnormality of the compressor 11 will occur based on a change trend of the supply of current to the compressor 11. In addition, the abnormality determination device 60 estimates a time at which an abnormality of the compressor 11 will occur due to an excessive decrease in the compression efficiency of the compressor 11 based on a change trend of the polytropic index.

Figure 3:
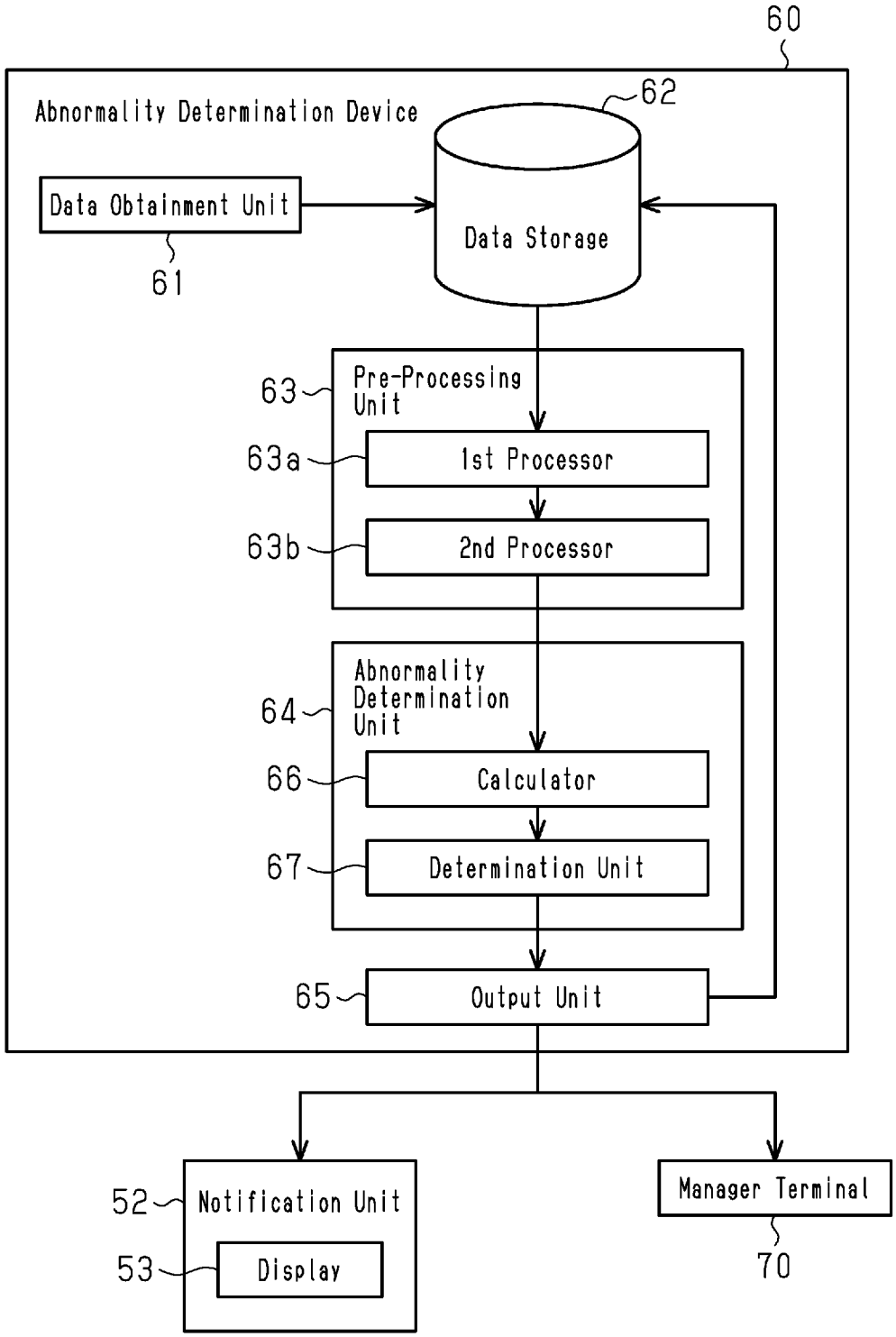
FIG. 3 is a block diagram showing electrical configurations of an abnormality determination device for the refrigeration apparatus.

As shown in FIG. 3, the abnormality determination device 60 includes a data obtainment unit 61, data storage 62, a pre-processing unit 63, an abnormality determination unit 64, and an output unit 65.

The data obtainment unit 61 is connected to the sensors 41 to 48 to communicate with the sensors 41 to 48. The data obtainment unit 61 receives time series data from the sensors 41 to 48. In an example, each of the sensors 41 to 48 outputs a detection result to the abnormality determination device 60 in each predetermined time TX. An example of the predetermined time TX is one hour. In an example, each of the sensors 41 to 48 stores detection results detected in a predetermined sampling cycle for the predetermined time TX and outputs an average of the detection results in the predetermined time TX to the abnormality determination device 60. Each of the sensors 41 to 48 may output a detection result detected at a clock time specified in each predetermined time TX to the abnormality determination device 60.

The data storage 62 is electrically connected to the data obtainment unit 61. The data storage 62 receives data from the data obtainment unit 61. The data storage 62 stores data from the data obtainment unit 61. In an example, the data storage 62 sequentially stores data from the data obtainment unit 61 in time order. In the present embodiment, the data storage 62 is configured to be a memory medium incorporated in the abnormality determination device 60. In this case, the data storage 62 may include, for example, non-volatile memory and volatile memory. The data storage 62 may be a memory medium provided outside the abnormality determination device 60 or outside the refrigeration apparatus 1. In this case, the data storage 62 may include at least one of universe serial bus (USB) memory, a secure digital (SD) memory card, and a hard disk drive (HDD) memory medium.

The pre-processing unit 63 removes, from the time series data, data that act as noise when determining whether the compressor 11 has an abnormality or estimating an abnormality occurrence time of the compressor 11 and replaces the section corresponding to the removed data with alternative data. The pre-processing unit 63 includes a first processor 63*a* and a second processor 63*b*. The noise data include data having momentary variations that occur, for example, immediately after activation of the compressor 11 and data in temporally noncontinuous sections.

The first processor 63*a* is electrically connected to the data storage 62. The second processor 63*b* is electrically connected to the first processor 63*a*. The first processor 63*a* extracts a section that is replaced with alternative data. Such a section includes, for example, at least one of a section in which the refrigeration apparatus 1 is stopped, a section immediately after activation of the compressor 11, a section immediately after deactivation of the compressor 11, or a section immediately after operation of the compressor 11 is switched. In the present embodiment, the first processor 63*a* extracts all of the section in which the refrigeration apparatus 1 is stopped, a section immediately after activation of the compressor 11, the section immediately after deactivation of the compressor 11, and the section immediately after the operation of the compressor 11 is switched.

The second processor 63*b* inputs alternative data into the section extracted by the first processor 63*a*. The alternative data is a value before or after the section extracted by the first processor 63*a* or a predetermined representative value. For example, when the first processor 63*a* extracts the section in which the refrigeration apparatus 1 is stopped, the second processor 63*b* uses a value in one of the sections before and after the section in which the refrigeration apparatus 1 is stopped as the alternative data. Data in sections being stopped, that is, temporally noncontinuous sections, are assumed to be, for example, zero. When the first processor 63*a* extracts the section immediately after activation of the compressor 11, the second processor 63*b* uses the value after the section immediately after activation of the compressor 11 as the alternative data. The value after the section immediately after activation of the compressor 11 may be an average value of data obtained during a predetermined period after the section immediately after activation of the compressor 11 or data obtained at a time immediately after the section immediately after activation of the compressor 11. When the first processor 63*a* extracts the section immediately after deactivation of the compressor 11, the second processor 63*b* uses a value in a section before the section immediately after deactivation of the compressor 11. The section before the section immediately after deactivation of the compressor 11 may be the section immediately before deactivation of the compressor 11. The value in the section before the section immediately after deactivation of the compressor 11 may be an average value of data in the section immediately before deactivation of the compressor 11 or may be data related to time immediately before deactivation of the compressor 11. When the first processor 63*a* extracts the section immediately after operation of the compressor 11 is switched, the second processor 63*b* uses a value in one of the sections before and after the section immediately after operation of the compressor 11 is switched as alternative data. The value in one of the sections before and after the section immediately after operation of the compressor 11 is switched may be an average value of data in one of the sections before and after the section immediately after operation of the compressor 11 is switched or may be data related to a predetermined time in one of the sections before and after the section immediately after operation of the compressor 11 is switched. As the process for calculating alternative data, data obtained before and after the section that is replaced with the alternative data may be interpolated (e.g., linearly interpolated), and the calculated value may be used as the alternative data.

The abnormality determination unit 64 is electrically connected to the pre-processing unit 63. The abnormality determination unit 64 uses the test data that has been processed by the pre-processing unit 63 to determine whether the compressor 11 has an abnormality or estimate an abnormality occurrence time of the compressor 11. The abnormality determination unit 64 includes a calculator 66 and a determination unit 67.

The calculator 66 calculates a first index value and a second index value to calculate a deviation degree of the compressor 11 from a normal state. The calculator 66 calculates the first index value from data related to operation of the refrigeration apparatus 1 in a first period. The calculator 66 calculates the second index value from data related to operation of the refrigeration apparatus 1 in a second period that differs in length from the first period. The calculator 66 calculates the deviation degree of the compressor 11 from the normal state based on the first index value and the second index value. In the present embodiment, the calculator 66 calculates the deviation degree of the compressor 11 from the normal state based on a deviation degree between the first index value and the second index value. The calculator 66 outputs the calculation result to the determination unit 67.

The determination unit 67 determines whether the compressor 11 has an abnormality or estimates an abnormality occurrence time of the compressor 11 based on the deviation degree of the compressor 11 from the normal state calculated by the calculator 66. The determination unit 67 outputs the determination result or the estimation result to the output unit 65.

The output unit 65 is electrically connected to the data storage 62 and the notification unit 52. The output unit 65 outputs the determination result of whether the compressor 11 has an abnormality or the estimation result of the abnormality occurrence time of the compressor 11 to the data storage 62 and the notification unit 52. The notification unit 52 uses, for example, the display 53 to show the determination result of whether the compressor 11 has an abnormality or the estimation result of an abnormality occurrence time of the compressor 11. The output unit 65 further includes a wireless communicator including an antenna. The output unit 65 is configured to communicate with a terminal of a manager (manager terminal 70) through the wireless communicator. The output unit 65 outputs the determination result of whether the compressor 11 has an abnormality or the estimation result of an abnormality occurrence time of the compressor 11 to the manager terminal 70. The manager terminal 70 may be a mobile communication device such as a smartphone or a tablet computer or may be a desktop personal computer.

The determination of whether the compressor 11 has an abnormality and the estimation of abnormality occurrence time of the compressor 11, which are performed by the abnormality determination unit 64, will now be described in detail.

The calculator 66 uses data stored in the data storage 62 and related to operation of the refrigeration apparatus 1 to calculate the first index value from a moving average of data related to operation of the refrigeration apparatus 1 in the first period and calculate the second index value from a moving average of data related to operation of the refrigeration apparatus 1 in the second period. The calculator 66 calculates the first index value and the second index value using data in the first period and the second period that are before execution of the process. Then, the calculator 66 calculates the deviation degree between the first index value and the second index value. In the present embodiment, data in the first period include data for one day, and data in the second period include data for ten days. In the present embodiment, a sampling cycle is one hour, and data related to operation of the refrigeration apparatus 1 is obtained per hour. Hence, data in the first period and data in the second period may be expressed by the number of data sets as well as the length of a period. Data for one day include twenty-four data sets, and data for ten days include two hundred and forty data sets.

The first index value and the second index value include a first example and a second example that are described as follows. In the first example, each of the first index value and the second index value is a polytropic index. In the second example, each of the first index value and the second index value is a compressor current ratio. The compressor current ratio is an example of a compressor current index and is expressed by a ratio of an actual value of current supplied to the compressor 11 to an estimated value of current supplied to the compressor 11. In the present embodiment, the ratio of the actual value of current supplied to the compressor 11 to the estimated value of current supplied to the compressor 11 is defined as the compressor current ratio.

The first example of the first index value and the second index value will be described.

The abnormality determination device 60 calculates data related to operation of the refrigeration apparatus 1. The data is, for example, a polytropic index. The polytropic index will be described with reference to FIG. 4. In a vapor compression refrigeration cycle such as the refrigeration apparatus 1, as shown in a Mollier diagram (pressure-enthalpy chart) of FIG. 4, the refrigerant circulates in the refrigerant circuit 20 as the refrigerant is compressed from point A to point B in a compression process and then cooled from point B to point C in a condensation process, decompressed from point C to point D in an expansion process, and heated from point D to point A in an evaporation process. In this refrigeration cycle, the compression efficiency of the compressor 11 is expressed by a polytropic index. The polytropic index is a value calculated from states of the refrigerant at the intake side and the discharge side of the compressor 11 and shows the relationship between pressure and a specific volume of the refrigerant when compressed. The polytropic index is a value unique to the compressor forming the refrigeration cycle. This value determines a curve of the compression process (in FIG. 4, approximately indicated by a straight line).

Figure 4:
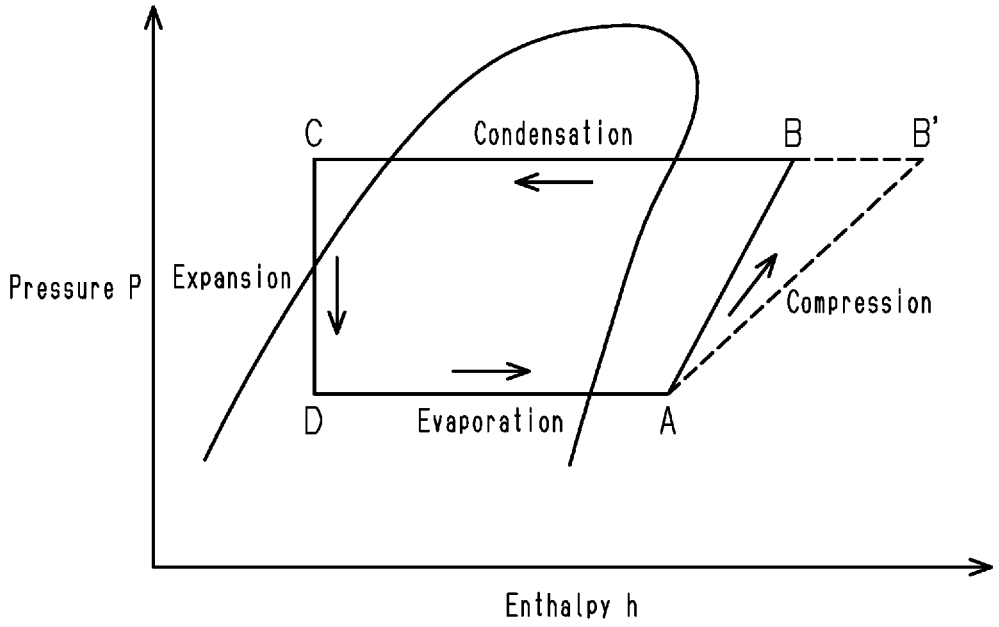
FIG. 4 is a graph showing an example of the relationship between enthalpy and pressure of the refrigeration apparatus.

For example, when the amount of the refrigerant leaked from the high-pressure side to the low-pressure side in the compressor 11 is increased due to deterioration of the compressor 11, the value of the polytropic index changes (increases). This results in a change in the slope of the compression process curve. In FIG. 4, the compression process curve indicated by the solid line shows an initial compression state at installation. The compression process curve indicated by the broken line shows a compression state when the compressor 11 has deteriorated. As shown in the compression process shown in FIG. 4, when the compressor 11 has deteriorated, in the compression process, the refrigerant is compressed from point A toward point B', which corresponds to a greater enthalpy than point B. Thus, deterioration of the compressor 11 increases the slope of the compression process curve.

A polytropic index is typically calculated by the following equation.

$$n = \frac{1}{1 - \log_{P1/P2}\left(\frac{T1}{T2}\right)} \quad \text{[Equation 1]}$$

In Equation 1, "n" denotes a polytropic index, "T1" denotes a temperature of the refrigerant at the intake side of the compressor 11, "T2" denotes a temperature of the refrigerant at the discharge side of the compressor 11, "P1" denotes pressure of the refrigerant at the intake side of the compressor 11, and "P2" denotes pressure of the refrigerant at the discharge side of the compressor 11. The abnormality determination device 60 calculates temperature T1 from a signal of the intake temperature sensor 43, temperature T2 from a signal of the discharge temperature sensor 41, pressure P1 from a signal of the intake pressure sensor 44, and pressure P2 from a signal of the discharge pressure sensor 42. When the abnormality determination device 60 does not calculate temperatures T1 and T2 and pressures P1 and P2, the controller 51 may calculate temperatures T1 and T2 and pressures P1 and P2. In this case, when the controller 51 outputs temperatures T1 and T2 and pressures P1 and P2 to the abnormality determination device 60, the abnormality determination device 60 obtains temperatures T1 and T2 and pressures P1 and P2.

Figure 5A:
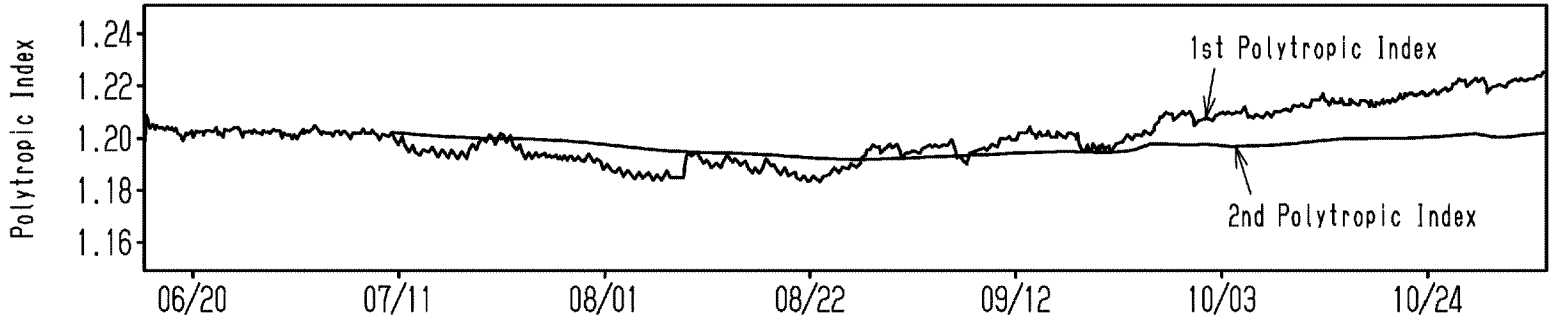
FIG. 5A is a graph showing an example of changes in a polytropic index of the refrigeration apparatus.

The calculator 66 calculates a polytropic index in the first period (hereafter, referred to as "first polytropic index") as the first index value and calculates a polytropic index in the second period (hereafter, referred to as "second polytropic index") as the second index value. FIG. 5A is a graph showing an example of changes in the first polytropic index and the second polytropic index. As shown in FIG. 5A, on or before September 12th, the first polytropic index is substantially equal to the second polytropic index. Between September 12th and October 3rd, the deviation degree gradually increases. From October 3rd, the deviation degree increases as time elapses.

Figure 5B:
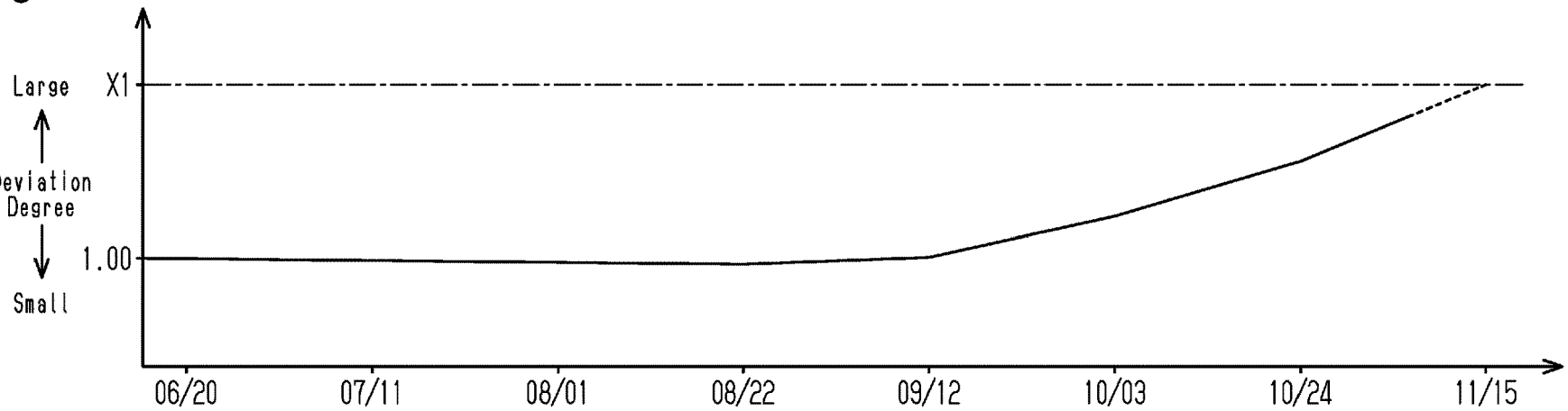
FIG. 5B is a graph showing an example of changes in a deviation degree of a first index value from a second index value.

The calculator 66 calculates, for example, the deviation degree between the first polytropic index and the second polytropic index. In the present embodiment, the deviation degree between the first polytropic index and the second polytropic index is expressed by a ratio of the first polytropic index to the second polytropic index. As the ratio increases, the deviation degree between the first polytropic index and the second polytropic index increases. The deviation degree between the first polytropic index and the second polytropic index may be expressed by a difference between the first polytropic index and the second polytropic index. As the difference increases, the deviation degree between the first polytropic index and the second polytropic index increases. FIG. 5B is a graph showing an example of changes in the deviation degree between the first polytropic index and the second polytropic index. As shown in FIG. 5B, on or before September 12th, the deviation degree between the first polytropic index and the second polytropic index is substantially 1.00. Between September 12th and October 3rd, the deviation degree between the first polytropic index and the second polytropic index gradually increases. From October 3rd, the deviation degree increases more steeply.

When the deviation degree between the first polytropic index and the second polytropic index is greater than or equal to a first threshold value X1, the determination unit 67 determines that the compressor 11 has an abnormality. The first threshold value X1 is set in advance by experiments or the like and is used to determine that the compression efficiency of the compressor 11 is excessively decreased.

The determination unit 67 estimates an abnormality occurrence time of the compressor 11 based on a change trend of the deviation degree between the first polytropic index and the second polytropic index. More specifically, the calculator 66 calculates a deviation degree between the first polytropic index and the second polytropic index for each day and outputs the deviation degree to the determination unit 67. The determination unit 67 obtains a change trend of the deviation degree based on the deviation degree between the first polytropic index and the second polytropic index of each day. The determination unit 67 estimates an abnormality occurrence time of the compressor 11 based on information indicating that the deviation degree has an increasing trend and the slope of the deviation degree. More specifically, the determination unit 67 estimates a time in which the deviation degree reaches the first threshold value X1 based on the slope of the deviation degree between the first polytropic index and the second polytropic index. The determination unit 67 may calculate the slope of the deviation degree using, for example, regression analysis or a straight line that connects deviation degrees in predetermined two periods. In an example, as shown in FIG. 5B, the determination unit 67 estimates a deviation degree from October 25th based on changes in the deviation degree between the first polytropic index and the second polytropic index obtained until October 24th (broken line in FIG. 5B). The determination unit 67 estimates an abnormality occurrence time of the compressor 11 based on a comparison of the first threshold value X1 with changes in the deviation degree from October 25th.

Figure 6:
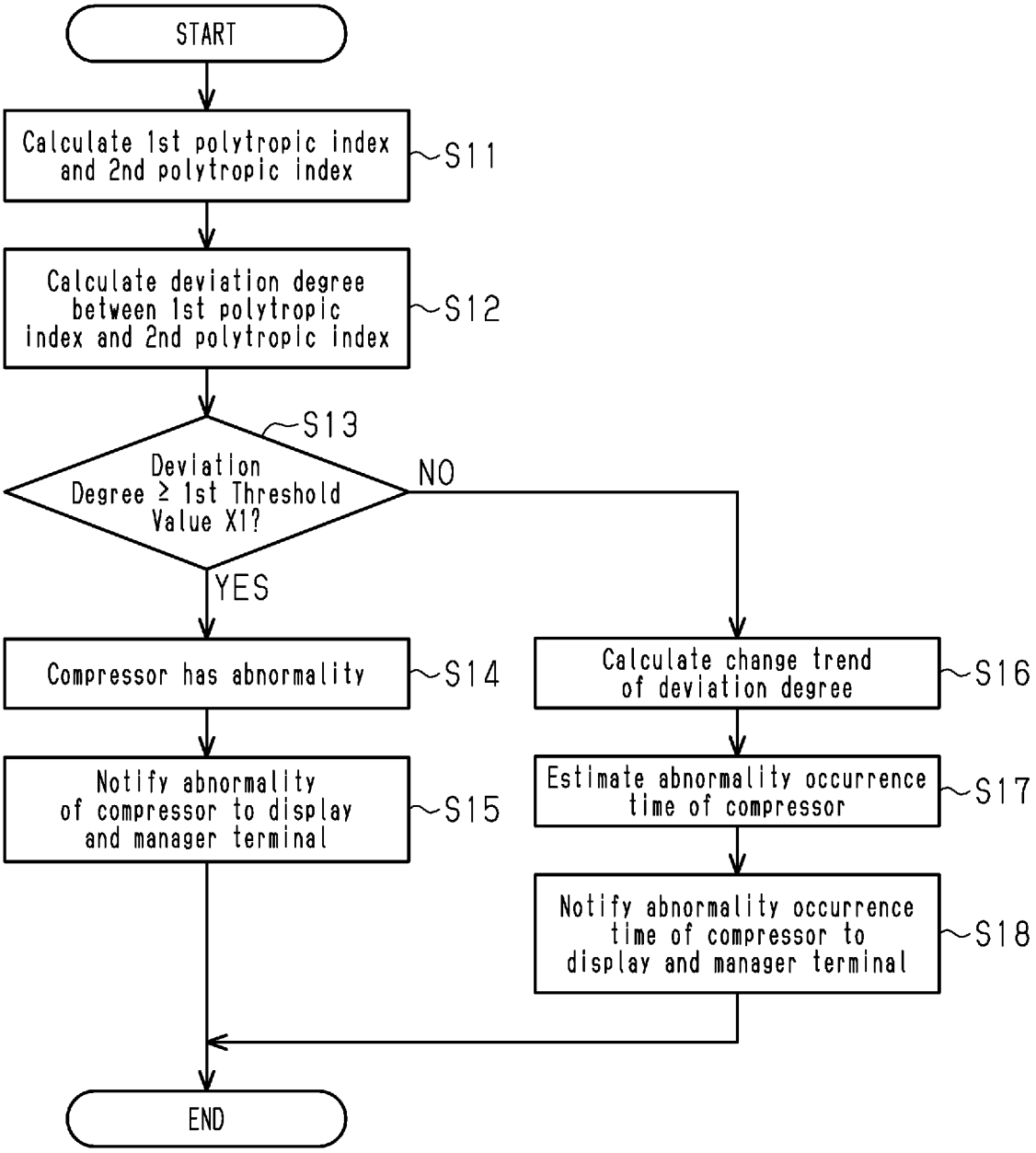
FIG. 6 is a flowchart showing an example of procedures of an abnormality determination process executed by the abnormality determination device.

Procedures of determining whether the compressor 11 has an abnormality or estimating an abnormality occurrence time of the compressor 11 performed by the abnormality determination device 60 will be described in detail with reference to FIG. 6. This process is executed, for example, at least one of when there is a user request, when the transporting refrigeration apparatus 1 or the abnormality determination device 60 is powered on, when transportation of the refrigeration apparatus 1 is completed, or when the pre-trip inspection of the refrigeration apparatus 1 is conducted. In the present embodiment, at each of when there is a user request, when the refrigeration apparatus 1 or the abnormality determination device 60 is powered on, when transportation of the refrigeration apparatus 1 is completed, and when the pre-trip inspection of the refrigeration apparatus 1 is conducted, the abnormality determination device 60 determines whether the compressor 11 has an abnormality or estimates an abnormality occurrence time of the compressor 11.

In step S11, the abnormality determination device 60 calculates a first polytropic index and a second polytropic index from data related to operation of the refrigeration apparatus 1 and then proceeds to step S12. In step S12, the abnormality determination device 60 calculates a deviation degree between the first polytropic index and the second polytropic index and then proceeds to step S13.

In step S13, the abnormality determination device 60 determines whether the deviation degree between the first polytropic index and the second polytropic index is greater than or equal to the first threshold value X1. When the affirmative determination is made in step S13, the abnormality determination device 60 proceeds to step S14 to determine that the compressor 11 has an abnormality and then proceeds to step S15. In step S15, the abnormality determination device 60 transmits the determination result to at least one of the display 53 or the manager terminal 70 and then temporarily ends the process. In step S15, the display 53 and the manager terminal 70 issue notification of the determination result of whether the compressor 11 has an abnormality or notification of the estimation result of an abnormality occurrence time of the compressor 11 at least one of when there is a user request, when the refrigeration apparatus 1 or the abnormality determination device 60 is powered on, when transportation of the refrigeration apparatus 1 is completed, or when the pre-trip inspection of the refrigeration apparatus 1 is conducted. In the present embodiment, the display 53 and the manager terminal 70 issue notification of the determination result of whether the compressor 11 has an abnormality or notification of the estimation result of an abnormality occurrence time of the compressor 11 each of when there is a user request, when the refrigeration apparatus 1 or the abnormality determination device 60 is powered on, when transportation of the refrigeration apparatus 1 is completed, and when the pre-trip inspection of the refrigeration apparatus 1 is conducted. In step S15, the result may be transmitted to the notification unit 52 instead of the display 53. When the notification unit 52 includes a speaker, the notification unit 52 may issue, using the speaker, notification of the determination result of whether the compressor 11 has an abnormality or notification of the estimation result of an abnormality occurrence time of the compressor 11.

When a negative determination is made in step S13, the abnormality determination device 60 proceeds to step S16 to calculate a change trend of the deviation degree between the first polytropic index and the second polytropic index and then proceeds to step S17.

In step S17, the abnormality determination device 60 estimates an abnormality occurrence time of the compressor 11 based on the slope of the deviation degree between the first polytropic index and the second polytropic index and then proceeds to step S18. In step S18, the abnormality determination device 60 transmits the estimation result to at least one of the display 53 or the manager terminal 70 and then temporarily ends the process. As described above, in the flowchart shown in FIG. 6, after determining whether the compressor 11 has an abnormality, the abnormality determination device 60 estimates an abnormality occurrence time of the compressor 11.

The second example of the first index value and the second index value will now be described.

The calculator 66 calculates an estimated value of current supplied to the compressor 11 and an actual value of current supplied to the compressor 11 and calculates the compressor current ratio as the ratio of the actual value of current supplied to the compressor 11 to the estimated value of current supplied to the compressor 11.

The calculator 66 calculates the estimated value of current supplied to the compressor 11 from, for example, at least one of the condensation temperature of the refrigerant circuit 20, the evaporation temperature of the refrigerant circuit 20, the operating frequency of the compressor 11, or the rotational speed of the compressor 11.

The calculator 66 calculates the actual value of current supplied to the compressor 11 in the compressor current ratio from a signal of the current sensor 45. The actual value of current supplied to the compressor 11 increases relative to the estimated value of current supplied to the compressor 11, for example, when the amount of the refrigerant leaked from the high-pressure side to the low-pressure side in the compression mechanism of the compressor 11 is increased due to deterioration of the compressor 11 or when the rotation resistance of the rotor of the motor in the compressor 11 is increased due to deterioration of the bearing (rolling bearing) that rotationally supports the rotor. Thus, the deviation degree of the actual value of current supplied to the compressor 11 from the estimated value of current supplied to the compressor 11 is correlated with the deterioration degree of the compressor 11.

Figure 7A:
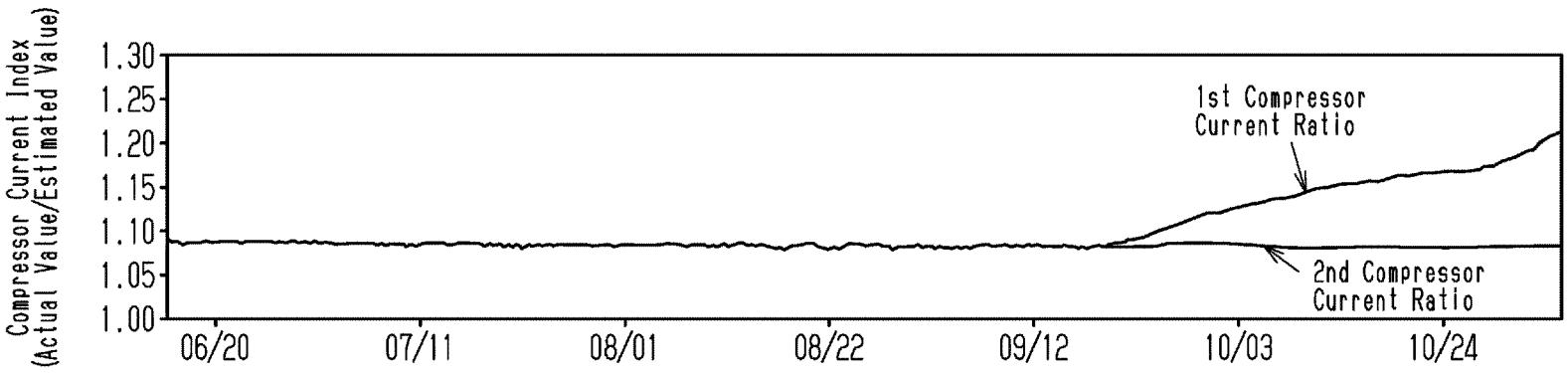
FIG. 7A is a graph showing an example of changes in a compressor current ratio of the refrigeration apparatus.

The calculator 66 calculates a compressor current ratio in the first period (hereafter, referred to as "first compressor current ratio") as the first index value and calculates a compressor current ratio in the second period (hereafter, referred to as "second compressor current ratio") as the second index value. FIG. 7A is a graph showing an example of changes in the first compressor current ratio and the second compressor current ratio. As shown in FIG. 7A, on or before September 12th, the first compressor current ratio is equal to the second compressor current ratio. Between September 12th and October 3rd, the deviation degree gradually increases. From October 3rd, the deviation degree increases as time elapses.

Figure 7B:
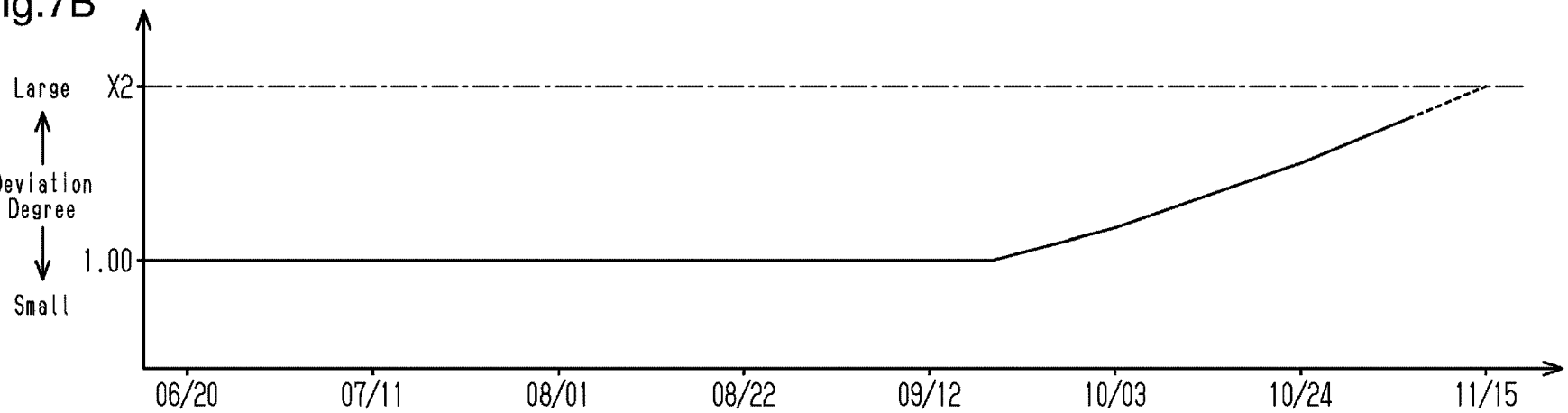
FIG. 7B is a graph showing an example of changes in a deviation degree of a first index value from a second index value.

The calculator 66 calculates, for example, the deviation degree between the first compressor current ratio and the second compressor current ratio. In the present embodiment, the deviation degree between the first compressor current ratio and the second compressor current ratio is expressed by a ratio of the first compressor current ratio to the second compressor current ratio. As the ratio increases, the deviation degree between the first compressor current ratio and the second compressor current ratio increases. The deviation degree between the first compressor current ratio and the second compressor current ratio may be expressed by a difference between the first compressor current ratio and the second compressor current ratio. As the difference increases, the deviation degree between the first compressor current ratio and the second compressor current ratio increases. FIG. 7B is a graph showing an example of changes in the deviation degree between the first compressor current ratio and the second compressor current ratio. As shown in FIG. 7B, on or before September 12th, the deviation degree between the first compressor current ratio and the second compressor current ratio is substantially 1.00. Between September 12th and October 3rd, the deviation degree between the first compressor current ratio and the second compressor current ratio gradually increases. From October 3rd, the deviation degree increases more steeply.

When the deviation degree between the first compressor current ratio and the second compressor current ratio is greater than or equal to a second threshold value X2, the determination unit 67 determines that the compressor 11 has an abnormality. The second threshold value X2 is set in advance by experiments or the like and is used to determine that the compressor 11 has an abnormality due to deterioration of the compressor 11.

The determination unit 67 estimates an abnormality occurrence time of the compressor 11 based on a change trend of the deviation degree between the first compressor current ratio and the second compressor current ratio. More specifically, the calculator 66 calculates, for example, a deviation degree between the first compressor current ratio and the second compressor current ratio for each day and outputs the deviation degree to the determination unit 67. The determination unit 67 obtains a change trend of the deviation degree, for example, based on the deviation degree between the first compressor current ratio and the second compressor current ratio of each day. The determination unit 67 estimates an abnormality occurrence time of the compressor 11 based on information indicating that the deviation degree has an increasing trend and the slope of the deviation degree. More specifically, the determination unit 67 estimates a time in which the deviation degree reaches the second threshold value X2 based on the slope of the deviation degree between the first compressor current ratio and the second compressor current ratio. In an example, as shown in FIG. 7B, the determination unit 67 estimates a deviation degree from October 25th based on changes in the deviation degree between the first compressor current ratio and the second compressor current ratio obtained until October 24th (broken line in FIG. 7B). The determination unit 67 estimates an abnormality occurrence time of the compressor 11 based on a comparison of the second threshold value X2 with changes in the deviation degree from October 25th.

Figure 8:
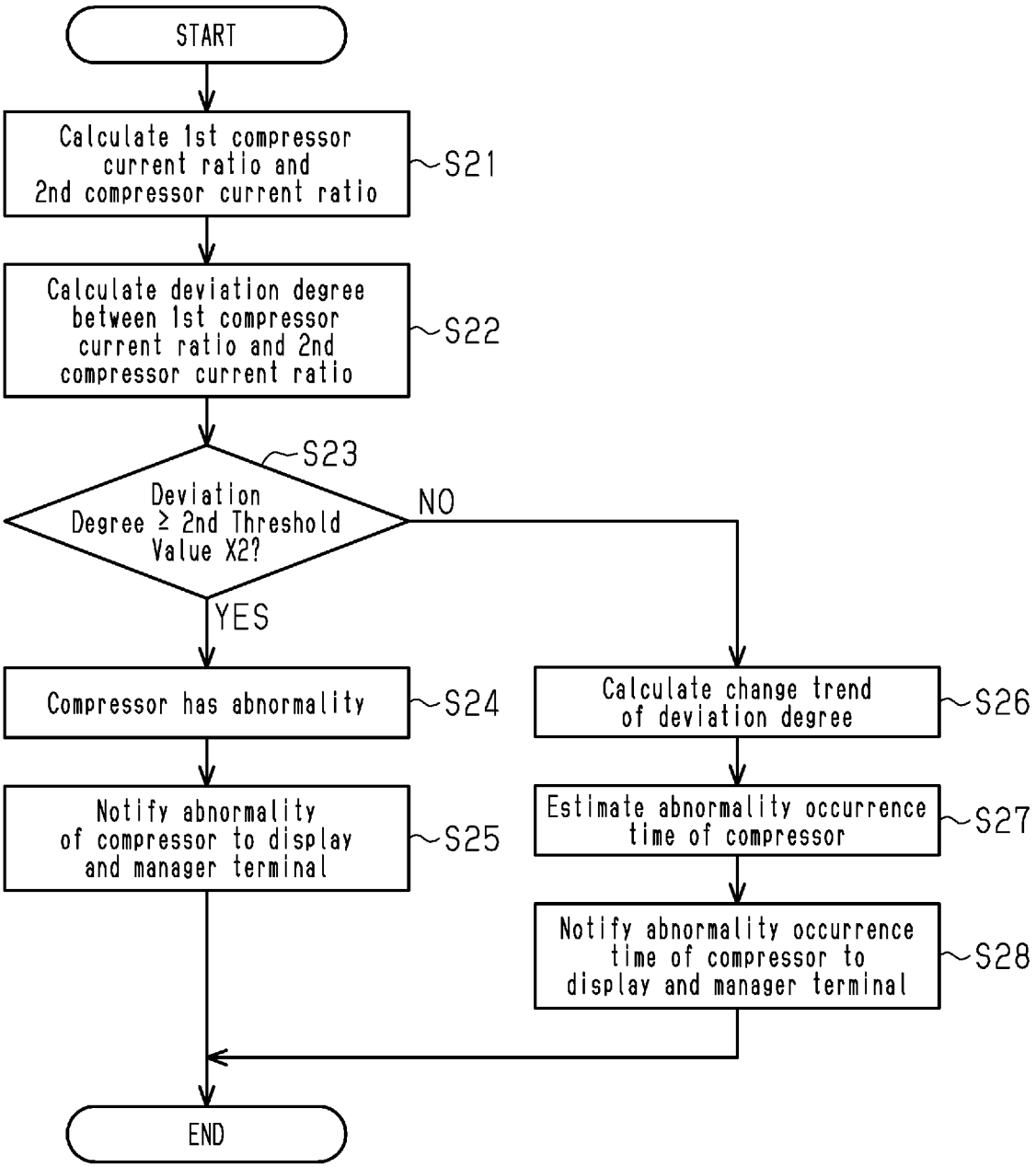
FIG. 8 is a flowchart showing another example of procedures of an abnormality determination process executed by the abnormality determination device.

Procedures of determination of whether the compressor 11 has an abnormality and estimation of an abnormality occurrence time of the compressor 11 performed by the abnormality determination device 60 will be described in detail with reference to FIG. 8. This process is executed, for example, at least one of when there is a user request, when the transporting refrigeration apparatus 1 or the abnormality determination device 60 is powered on, when transportation of the refrigeration apparatus 1 is completed, or when the pre-trip inspection of the refrigeration apparatus 1 is conducted. In the present embodiment, at each of when there is a user request, when the refrigeration apparatus 1 or the abnormality determination device 60 is powered on, when transportation of the refrigeration apparatus 1 is completed, and when the pre-trip inspection of the refrigeration apparatus 1 is conducted, the abnormality determination device 60 determines whether the compressor 11 has an abnormality or estimates an abnormality occurrence time of the compressor 11.

In step S21, the abnormality determination device 60 calculates a first compressor current ratio and a second compressor current ratio from data related to operation of the refrigeration apparatus 1 and then proceeds to step S22. In step S22, the abnormality determination device 60 calculates a deviation degree between the first compressor current ratio and the second compressor current ratio and then proceeds to step S23.

In step S23, the abnormality determination device 60 determines whether the deviation degree between the first compressor current ratio and the second compressor current ratio is greater than or equal to the second threshold value X2. When an affirmative determination is made in step S23, the abnormality determination device 60 proceeds to step S24 to determine that the compressor 11 has an abnormality and then proceeds to step S25. In step S25, the abnormality determination device 60 transmits the determination result to at least one of the display 53 or the manager terminal 70 and then temporarily ends the process. In step S25, the display 53 and the manager terminal 70 issue notification of the determination result of whether the compressor 11 has an abnormality or notification of the estimation result of an abnormality occurrence time of the compressor 11 at least one of when there is a user request, when the refrigeration apparatus 1 or the abnormality determination device 60 is powered on, when transportation of the refrigeration apparatus 1 is completed, or when the pre-trip inspection of the refrigeration apparatus 1 is conducted. In the present embodiment, the display 53 and the manager terminal 70 issue notification of the determination result of whether the compressor 11 has an abnormality or notification of the estimation result of an abnormality occurrence time of the compressor 11 each of when there is a user request, when the refrigeration apparatus 1 or the abnormality determination device 60 is powered on, when transportation of the refrigeration apparatus 1 is completed, and when the pre-trip inspection of the refrigeration apparatus 1 is conducted. In step S25, the result may be transmitted to the notification unit 52 instead of the display 53. When the notification unit 52 includes a speaker, the notification unit 52 may issue, using the speaker, notification of the determination result of whether the compressor 11 has an abnormality or notification of the estimation result of an abnormality occurrence time of the compressor 11.

When a negative determination is made in step S23, the abnormality determination device 60 proceeds to step S26 to calculate a change trend of the deviation degree between the first compressor current ratio and the second compressor current ratio and then proceeds to step S27.

In step S27, the abnormality determination device 60 estimates an abnormality occurrence time of the compressor 11 based on a slope of changes in the deviation degree between the first compressor current ratio and the second compressor current ratio and then proceeds to step S28. In step S28, the abnormality determination device 60 transmits the estimation result to at least one of the display 53 or the manager terminal 70 and then temporarily ends the process. As described above, in the flowchart shown in FIG. 8, after determining whether the compressor 11 has an abnormality, the abnormality determination device 60 estimates an abnormality occurrence time of the compressor 11.

The method for determining an abnormality of the compressor 11 executed by the abnormality determination device 60 and described above includes a data storing step, a first calculating step, a second calculating step, and a determining step. The steps will be described below.

The data storing step is a step of storing data related to operation of the refrigeration apparatus 1. In an example, the data storing step stores data related to operation of the refrigeration apparatus 1 and obtained from the data obtainment unit 61 in the data storage 62 as time series data.

The first calculating step is a step of calculating the first index value from data related to operation of the refrigeration apparatus 1 in the first period and calculating the second index value from data related to operation of the refrigeration apparatus 1 in the second period. In an example, the first calculating step is executed by the calculator 66. The first calculating step is a step of calculating the first index value from a moving average of data related to operation of the refrigeration apparatus 1 in the first period and calculating the second index value from a moving average of data related to operation of the refrigeration apparatus 1 in the second period. In an example, the first calculating step includes a pre-processing step that removes data that act as noise when determining whether the compressor 11 has an abnormality or estimating an abnormality occurrence time of the compressor 11 and replaces it with alternative data with the pre-processing unit 63. The relationship of the first calculating step with FIGS. 6 and 8 is that step S11 in FIG. 6 and step S21 in FIG. 8 correspond to the first calculating step.

The second calculating step is a step of calculating a deviation degree of the compressor 11 from the normal state based on the first index value and the second index value. In an example, the second calculating step is executed by the calculator 66. The relationship of the second calculating step with FIGS. 6 and 8 is that step S12 in FIG. 6 and step S22 in FIG. 8 correspond to the second calculating step.

The determining step is a step of determining whether the compressor 11 has an abnormality or estimating an abnormality occurrence time of the compressor 11 based on the deviation degree of the compressor 11 from the normal state. In an example of the determining step, when the second index value refers to the normal state of the compressor 11 and the deviation degree of the first index value from the second index value is greater than or equal to a threshold value, it is determined that the compressor 11 has an abnormality. In the determining step, a time at which the deviation degree reaches the threshold value is estimated based on a change trend of the deviation degree of the first index value from the second index value, so that the abnormality occurrence time of the compressor 11 is estimated. The relationship of the determining step with FIGS. 6 and 8 is that steps S13 to S18 in FIG. 6 and steps S23 to S28 in FIG. 8 correspond to the determining step.

The operation of the present embodiment will now be described.

The abnormality determination device 60 calculates the second index value from a moving average of data related to operation of the refrigeration apparatus 1 in the second period and uses the calculated second index value as reference. In the present embodiment, data in the second period is related to operation of the refrigeration apparatus 1 obtained during a long period of ten days to thirty days and thus is subtly affected by variations related to operation of the refrigeration apparatus 1 obtained during a short period such as one day.

The abnormality determination device 60 also calculates the first index value from a moving average of data related to operation of the refrigeration apparatus 1 in the first period. In the present embodiment, data in the first period is related to operation of the refrigeration apparatus 1 in a short period, that is, one day, and thus is greatly affected by recent variations related to operation of the refrigeration apparatus 1.

As described above, the second index value, which is subtly affected by recent variations related to operation of the refrigeration apparatus 1, is used as reference to monitor how much the first index value, which is greatly affected by variations related to operation of the refrigeration apparatus 1, is deviated from the second index value. This facilitates extraction of variations related to operation of the refrigeration apparatus 1. With this configuration, when the compressor 11 has an abnormality, the first index value is prominently deviated from the second index value so that the abnormality determination device 60 determines that the compressor 11 has an abnormality. In addition, the abnormality determination device 60 obtains a change trend of the deviation degree of the first index value from the second index value and estimates changes in the deviation degree to estimate an abnormality occurrence time of the compressor 11.

The present embodiment has the following advantages.

(1) In data related to operation of the refrigeration apparatus 1, the calculator 66 calculates a first index value from data related to operation of the refrigeration apparatus 1 in the first period and calculates a second index value from data related to operation of the refrigeration apparatus 1 in the second period that differs length from the first period. Then, the calculator 66 calculates a deviation state of the compressor 11 from the normal state based on the first index value and the second index value. The determination unit 67 determines whether the compressor 11 has an abnormality or estimates an abnormality occurrence time of the compressor 11 based on the deviation degree of the compressor 11 from the normal state. With this configuration, the deviation state of the compressor 11 from the normal state is calculated based on the state of difference between the first index value and the second index value calculated using data related to operation of the refrigeration apparatus 1 including the pre-trip inspection operation of the refrigeration apparatus 1 and normal operations of the refrigeration apparatus 1 such as the cooling operation and the defrosting operation. The determination of whether the compressor 11 has an abnormality or the estimation of an abnormality occurrence time is performed based on the deviation state of the compressor 11 from the normal state. Thus, the determination of whether the compressor 11 has an abnormality or the estimation of an abnormality occurrence time is performed without performing a special operation for determining an abnormality of the compressor 11.

(2) The second index value, which is calculated from the long second period, is subtly affected by variations related to operation of the refrigeration apparatus 1. The first index value, which is calculated from the short first period, is greatly affected by variations related to operation of the refrigeration apparatus 1. In the present embodiment, the calculator 66 calculates the first index value and the second index value and calculates the deviation degree of the compressor 11 from the normal state based on the deviation degree between the first index value and the second index value. This facilitates extraction of variations in operation of the refrigeration apparatus 1. Whether the compressor 11 has an abnormality is determined or an abnormality occurrence time of the compressor 11 is estimated based on the variations in operation of the refrigeration apparatus 1.

(3) The first index value is calculated from a moving average of data related to operation of the refrigeration apparatus 1 in the first period. The second index value is calculated from a moving average of data related to operation of the refrigeration apparatus 1 in the second period. With this configuration, whether the compressor 11 has an abnormality is determined or an abnormality occurrence time of the compressor 11 is estimated based on a deviation degree between variations in operation of the refrigeration apparatus 1 during a long period and variations in operation of the refrigeration apparatus 1 during a short period.

(4) The first index value and the second index value include a polytropic index. This allows for determination of whether the compressor 11 has an abnormality or estimation of an abnormality occurrence time of the compressor 11 based on variations related to the compression process of the compressor 11.

(5) The first index value and the second index value include the compressor current ratio. This allows for determination of whether the compressor 11 has an abnormality due to aging and deterioration of the compressor 11 such as deterioration of a bearing of the compressor 11 or for estimation of an abnormality occurrence time of the compressor 11.

(6) The pre-processing unit 63 eliminates data related to operation of the refrigeration apparatus 1 and acting as noise when determining whether the compressor 11 has an abnormality or estimating an abnormality occurrence time of the compressor 11 and replaces it with alternative data. The determination of whether the compressor 11 has an abnormality or the estimation of an abnormality occurrence time of the compressor 11 is performed with high accuracy.

(7) When the first processor 63*a* extracts a section immediately after activation of the compressor 11, the second processor 63*b* uses a value after the section immediately after activation of the compressor 11 as the alternative data. When the first processor 63*a* extracts the section immediately after deactivation of the compressor 11, the second processor 63*b* uses a value in a section before the section immediately after deactivation of the compressor 11. When the first processor 63*a* extracts the section immediately after operation of the compressor 11 is switched, the second processor 63*b* uses a value in one of the sections before and after the section immediately after operation of the compressor 11 is switched as alternative data. This configuration uses data temporally close to the section extracted by the first processor 63*a* as alternative data, so that the deviation degree of the alternative data from the actual data related to operation of the refrigeration apparatus 1 is decreased. As a result, the determination of whether the compressor 11 has an abnormality and the estimation of an abnormality occurrence time of the compressor 11 are performed with high accuracy.

(8) The notification unit 52 indicates occurrence of an abnormality of the compressor 11 or an abnormality occurrence time of the compressor 11 in the display 53 of the refrigeration apparatus 1 or the manager terminal 70. This allows the manger or the operator of the refrigeration apparatus 1 to recognize the abnormality of the compressor 11 or the abnormality occurrence time.

MODIFIED EXAMPLES

The description related to the above embodiments exemplifies, without any intention to limit, applicable forms of an abnormality determination device, a refrigeration apparatus including the abnormality determination device, and a method for determining an abnormality of a compressor according to the present disclosure. The abnormality determination device, the refrigeration apparatus including the abnormality determination device, and the method for determining an abnormality of the compressor according to the present disclosure can be applicable to, for example, modified examples of the embodiments that are described below and combinations of at least two of the modified examples that do not contradict each other. In the following modified examples, the same reference characters are given to those elements that are the same as the corresponding elements of the above embodiment. Such elements will not be described in detail.

In the embodiment, the deviation degree between the first index value and the second index value is expressed by the ratio of the first index value to the second index value. However, there is no limitation to such a configuration. The process of calculating the deviation degree between the first index value and the second index value may be changed in any manner. In an example, the calculator 66 may calculate the deviation degree between the first index value and the second index value based on at least one of a standard deviation, skewness, likelihood, kurtosis, or an average that is obtained using the first index value and the second index value.

In the embodiment, the abnormality determination device 60 performs both determination of whether the compressor 11 has an abnormality and estimation of an abnormality occurrence time of the compressor 11. Instead, the abnormality determination device 60 may perform only determination of whether the compressor 11 has an abnormality. Alternatively, when the deviation degree between the first index value and the second index value is less than the first threshold value X1 (second threshold value X2), the abnormality determination device 60 may perform only estimation of an abnormality occurrence time of the compressor 11. In this case, the abnormality determination device 60 may omit determination of whether the compressor 11 has an abnormality.

In the embodiment, the pre-processing unit 63 removes, from time series data, data that act as noise when determining whether the compressor 11 has an abnormality or estimating an abnormality occurrence time of the compressor 11, and replaces the section corresponding to the removed data with alternative data. However, there is no limitation to such a configuration. The pre-processing unit 63 may only remove, from time series data, data that act as noise when determining whether the compressor 11 has an abnormality or estimating an abnormality occurrence time of the compressor 11. This configuration accurately determines whether the compressor 11 has an abnormality or estimates an abnormality occurrence time of the compressor 11.

In the embodiment, the abnormality determination device 60 uses one of the polytropic index and the compressor current ratio to determine whether the compressor 11 has an abnormality or estimate an abnormality occurrence time of the compressor 11. However, there is no limitation to such a configuration. For example, the abnormality determination device 60 may use both the polytropic index and the compressor current ratio to determine whether the compressor 11 has an abnormality or estimate an abnormality occurrence time of the compressor 11.

In the embodiment, the first index value and the second index value may be calculated from the estimated value of current supplied to the compressor 11 or the actual value of current supplied to the compressor 11 instead of the compressor current ratio. In an example, the calculator 66 calculates the first index value from a moving average of estimation values of current supplied to the compressor 11 in the first period and calculates the second index value from a moving average of estimation values of current supplied to the compressor 11 in the second period. In an example, the calculator 66 calculates the first index value from a moving average of actual values of current supplied to the compressor 11 in the first period and calculates the second index value from a moving average of actual values of current supplied to the compressor 11 in the second period.

In the embodiment, the data storage 62 may be an external server of the refrigeration apparatus 1 connected to the refrigeration apparatus 1 to communicate with the refrigeration apparatus 1. An example of the server includes a cloud server. More specifically, the abnormality determination device 60 transmits data obtained in the data obtainment unit 61 to the server so that the server stores the data.

In the embodiment, the abnormality determination device 60 and the notification unit 52 are separately arranged. Instead, the abnormality determination device 60 may include the notification unit 52.

In the embodiment, the refrigeration apparatus 1 is configured to be transported. However, the configuration of a refrigeration apparatus is not limited to this. For example, a refrigeration apparatus may be used for a stationary storage. When the refrigeration apparatus 1 is used as a refrigeration apparatus other than a transporting refrigeration apparatus, the abnormality determination device 60 determines whether the compressor 11 has an abnormality or estimates an abnormality occurrence time of the compressor 11 at least one of when there is a user request, when the refrigeration apparatus 1 or the abnormality determination device 60 is powered on, or when the pre-trip inspection of the refrigeration apparatus 1 is conducted. In addition, the notification unit 52 issues notification of a determination result of whether the compressor 11 has an abnormality or notification of an estimation time of an abnormality occurrence time at least one of when there is a user request, when the refrigeration apparatus 1 or the abnormality determination device 60 is powered on, or when the pre-trip inspection of the refrigeration apparatus 1 is conducted.

Figure 9:
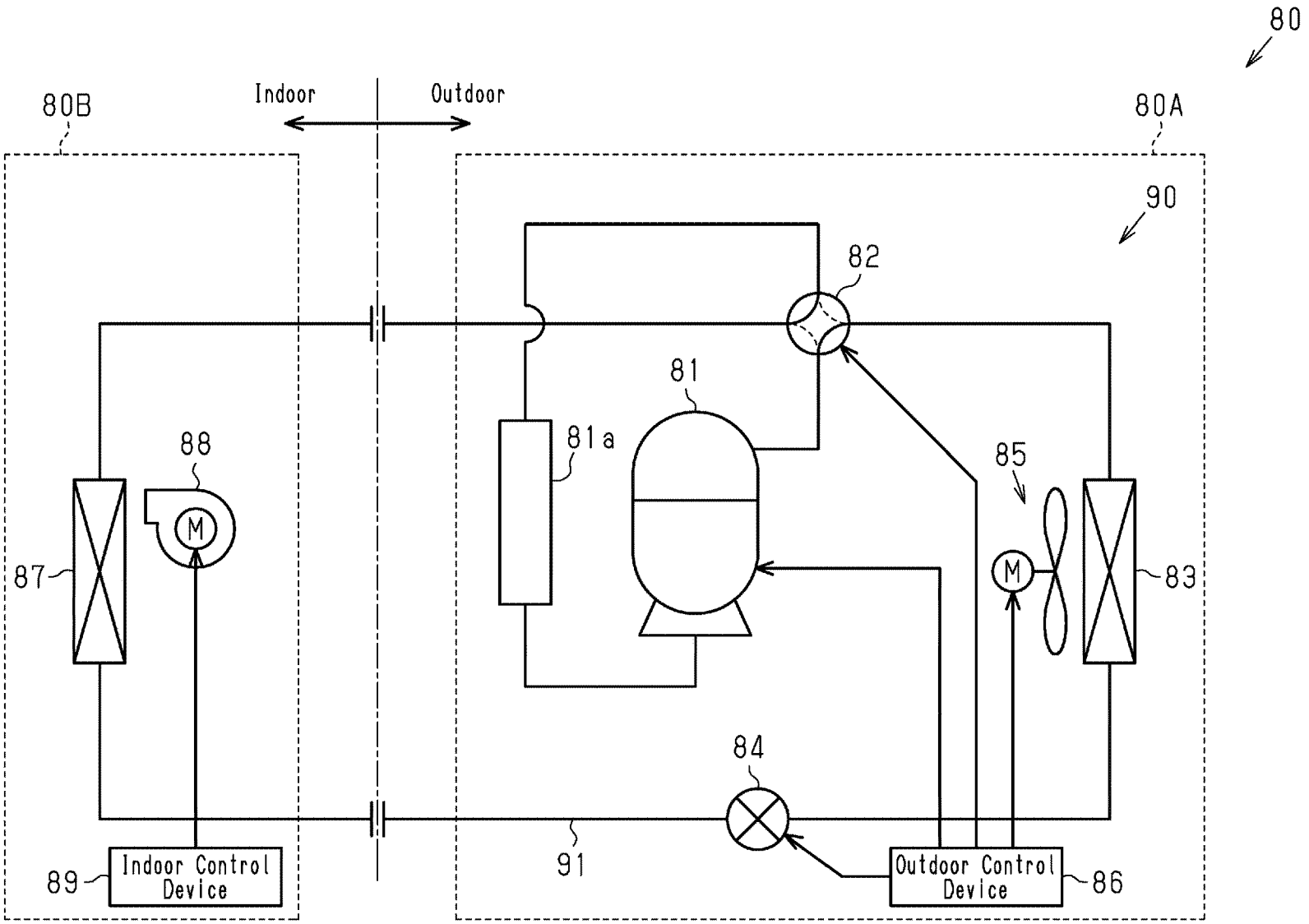
FIG. 9 is a conceptual diagram showing a modified example of a refrigeration apparatus.

In the embodiment, the refrigeration apparatus 1 is configured to be installed on a container. However, the configuration of a refrigeration apparatus is not limited to this. For example, as shown in FIG. 9, a refrigeration apparatus may be used as an air conditioner 80. The air conditioner 80 includes a refrigerant circuit 90 in which an outdoor unit 80A and a wall-mounted indoor unit 80B are connected by a refrigerant pipe 91. The outdoor unit 80A is arranged outdoors. The indoor unit 80B is installed on an indoor wall surface.

The outdoor unit 80A includes a compressor 81 having a variable displacement varied by a change in an operating frequency, a four-way switching valve 82, an outdoor heat exchanger 83, an expansion valve 84, an outdoor fan 85, and an outdoor control device 86. The compressor 81 is, for example, a rocking piston compressor and includes, for example, a compression mechanism, a motor, and a crankshaft that transmits driving power of the motor to the compression mechanism. The outdoor heat exchanger 83 exchanges heats between the outside air and the refrigerant and may be, for example, a fin-and-tube heat exchanger. The expansion valve 84 is, for example, an electronic expansion valve. The outdoor fan 85 includes a motor, which is a drive source having a changeable number of revolutions, and an impeller connected to an output shaft of the motor. An example of the impeller is a propeller fan. When the impeller is rotated by the motor, the outdoor fan 85 generates an airflow of outdoor air flowing through the outdoor heat exchanger 83. The outdoor control device 86 is electrically connected to the motor of the compressor 81, the four-way switching valve 82, the expansion valve 84, and the motor of the outdoor fan 85 to control their operations.

The indoor unit 80B includes an indoor heat exchanger 87, an indoor fan 88, and an indoor control device 89. The indoor heat exchanger 87 exchanges heat between the inside air and the refrigerant and may be, for example, a fin-and-tube heat exchanger. The indoor fan 88 includes a motor, which is a drive source having a changeable number of revolutions, and an impeller connected to an output shaft of the motor. An example of the impeller is a cross-flow fan. The indoor control device 89 is electrically connected to the indoor fan 88 to control operation of the indoor fan 88.

The refrigerant circuit 90 is formed by connecting the compressor 81, the four-way switching valve 82, the outdoor heat exchanger 83, and the expansion valve 84 to the indoor heat exchanger 87 and an accumulator 81*a* with the refrigerant pipe 91 as a loop. The refrigerant circuit 90 is configured to execute a vapor compression refrigeration cycle that reversibly circulates the refrigerant by switching the four-way switching valve 82.

More specifically, when the four-way switching valve 82 is switched to a cooling mode connection state (illustrated with solid line), the refrigerant circuit 90 forms a cooling cycle in which the refrigerant circulates in the order of the compressor 81, the four-way switching valve 82, the outdoor heat exchanger 83, the expansion valve 84, the indoor heat exchanger 87, the four-way switching valve 82, the accumulator 81*a*, and the compressor 81. As a result, the air conditioner 80 performs a cooling operation in which the outdoor heat exchanger 83 acts as a condenser, and the indoor heat exchanger 87 acts as an evaporator. When the four-way switching valve 82 is switched to a heating mode connection state (illustrated with broken lines), the refrigerant circuit 90 forms a heating cycle in which the refrigerant circulates in the order of the accumulator 81*a*, the compressor 81, the four-way switching valve 82, the indoor heat exchanger 87, the expansion valve 84, the outdoor heat exchanger 83, the four-way switching valve 82, and the compressor 81. As a result, the air conditioner 80 performs a heating operation in which the indoor heat exchanger 87 acts as a condenser and the outdoor heat exchanger 83 acts as an evaporator.

In the air conditioner 80, for example, the abnormality determination device 60 (not shown in FIG. 9) is arranged on one of the outdoor control device 86 and the indoor control device 89. The notification unit 52 (not shown in FIG. 9) is arranged on, for example, a remote controller of the air conditioner 80.

In the embodiment, the refrigeration apparatus 1 includes the abnormality determination device 60. However, the refrigeration apparatus 1 is not limited to this configuration. For example, the abnormality determination device 60 may be omitted from the refrigeration apparatus 1. The abnormality determination device 60 and the refrigeration apparatus 1 may be separately arranged. In an example, the abnormality determination device 60 may be arranged on a server configured to communicate with the refrigeration apparatus 1. In this case, the refrigeration apparatus 1 communicates with the abnormality determination device 60 to obtain a determination result of whether the compressor 11 has an abnormality and an estimation result of an abnormality occurrence time of the compressor 11.

While the embodiments of the device have been described herein above, it is to be appreciated that various changes in form and detail may be made without departing from the spirit and scope of the device presently or hereafter claimed.

The invention claimed is:

1. A refrigeration apparatus comprising:

a refrigerant circuit including a compressor, a condenser, and an evaporator;

at least one sensor; and an abnormality determination device configured to determine an abnormality of the compressor, the refrigerant circuit being configured to circulate a refrigerant through the compressor, the condenser, and the evaporator, the abnormality determination device comprising processing circuitry configured to:

calculate a deviation degree of the compressor from a normal state based on data related to operation of the refrigeration apparatus received from the at least one sensor; and determine whether the compressor has an abnormality or estimates an abnormality occurrence time based on a calculation result of the processing circuitry, wherein the data related to operation of the refrigeration apparatus include data related to operation of the refrigeration apparatus in a first period and data related to operation of the refrigeration apparatus in a second period that differs in length from the first period, the processing circuitry is configured to calculate a first index value from the data related to operation of the refrigeration apparatus in the first period and calculate a second index value from the data related to operation of the refrigeration apparatus in the second period, the processing circuitry is configured to calculate the deviation degree of the compressor from the normal state based on the first index value and the second index value, and the processing circuitry is configured to determine whether the compressor has an abnormality or estimate an abnormality occurrence time based on the deviation degree of the compressor from the normal state, wherein the processing circuitry is configured to calculate the first index value and the second index value from the data related to operation of the refrigeration apparatus and remove from the data related to the operation of the refrigeration apparatus at least one of data in a section of the data related to the operation of the refrigeration apparatus corresponding to the refrigeration apparatus being stopped, data in a section of the data related to the operation of the refrigeration apparatus corresponding to immediately after activation of the compressor, data in a section of the data related to the operation of the refrigeration apparatus corresponding to immediately after deactivation of the compressor, or data in a section of the data related to the operation of the refrigeration apparatus corresponding to immediately after operation of the compressor is switched, the refrigeration apparatus further includes a display or speaker that issues a notification of a determination result of whether the compressor has an abnormality or a notification of an estimation result of an abnormality occurrence time, and the display or speaker issues a notification of a determination result of whether the compressor has an abnormality or a notification of an estimation result of an abnormality occurrence time at least one of when there is a user request, when the refrigeration apparatus or the abnormality determination device is powered on, or when a pre-trip inspection of the refrigeration apparatus is conducted.

2. The refrigeration apparatus according to claim 1, wherein the processing circuitry is configured to calculate the deviation degree of the compressor from the normal state based on a deviation degree between the first index value and the second index value.

3. The refrigeration apparatus according to claim 1, wherein the data related to operation of the refrigeration apparatus in the first period include data for one day, and the data related to operation of the refrigeration apparatus in the second period include data for ten days or more and thirty days or less.

4. The refrigeration apparatus according to claim 3, wherein the data related to operation of the refrigeration apparatus in the first period include twenty-four data sets, and the data related to operation of the refrigeration apparatus in the second period include two hundred and forty data sets or more and seven hundred and twenty data sets or less.

5. The refrigeration apparatus according to claim 1, wherein the processing circuitry is configured to calculate the first index value from a moving average of the data related to operation of the refrigeration apparatus in the first period, and the processing circuitry is configured to calculate the second index value from a moving average of the data related to operation of the refrigeration apparatus in the second period.

6. The refrigeration apparatus according to claim 1, wherein each of the first index value and the second index value includes a polytropic index.

7. The refrigeration apparatus according to claim 1, wherein each of the first index value and the second index value includes one of an estimated current value obtained by estimating current supplied to the compressor, an actual current value obtained by measuring current supplied to the compressor, or a compressor current index calculated in accordance with the estimated current value and the actual current value.

8. The refrigeration apparatus according to claim 7, wherein the estimated current value is calculated based on at least one of a condensation temperature of the refrigerant circuit, an evaporation temperature of the refrigerant circuit, an operating frequency of the compressor, or a rotational speed of the compressor.

9. The refrigeration apparatus according to claim 1, wherein the processing circuitry is configured to calculate the first index value and the second index value and replace the removed section of the data related to the operation of the refrigeration with alternative data.

10. The refrigeration apparatus according to claim 9, wherein the alternative data is one of a predetermined representative value, a value of the data related to the operation of the refrigeration apparatus corresponding to before the removed section associated with the refrigeration apparatus being stopped, a value of the data related to the operation of the refrigeration apparatus corresponding to after the removed section associated with the refrigeration apparatus being stopped, a section of the data related to the operation of the refrigeration apparatus corresponding to immediately after activation of the compressor, a section of the data related to the operation of the refrigeration apparatus corresponding to immediately after deactivation of the compressor, or a section of the data related to the operation of the refrigeration apparatus corresponding to immediately after operation of the compressor is switched.

11. The refrigeration apparatus according to claim 1, wherein the processing circuitry is configured to calculate the deviation degree between the first index value and the second index value based on at least one of a standard deviation, skewness, likelihood, kurtosis, or an average that is obtained using the first index value and the second index value.

12. A refrigeration apparatus comprising:

a refrigerant circuit including a compressor, a condenser, and an evaporator;

at least one sensor; and an abnormality determination device configured to determine an abnormality of the compressor, the refrigerant circuit being configured to circulate a refrigerant through the compressor, the condenser, and the evaporator, the abnormality determination device comprising processing circuitry configured to:

calculate a deviation degree of the compressor from a normal state based on data related to operation of the refrigeration apparatus received from the at least one sensor; and determine whether the compressor has an abnormality or estimates an abnormality occurrence time based on a calculation result of the processing circuitry, wherein the data related to operation of the refrigeration apparatus include data related to operation of the refrigeration apparatus in a first period and data related to operation of the refrigeration apparatus in a second period that differs in length from the first period, the processing circuitry is configured to calculate a first index value from the data related to operation of the refrigeration apparatus in the first period and calculate a second index value from the data related to operation of the refrigeration apparatus in the second period, the processing circuitry is configured to calculate the deviation degree of the compressor from the normal state based on the first index value and the second index value, and the processing circuitry is configured to determine whether the compressor has an abnormality or estimate an abnormality occurrence time based on the deviation degree of the compressor from the normal state, wherein the processing circuitry is configured to calculate the first index value and the second index value from the data related to operation of the refrigeration apparatus and remove from the data related to the operation of the refrigeration apparatus at least one of data in a section of the data related to the operation of the refrigeration apparatus corresponding to the refrigeration apparatus being stopped, data in a section of the data related to the operation of the refrigeration apparatus corresponding to immediately after activation of the compressor, data in a section of the data related to the operation of the refrigeration apparatus corresponding to immediately after deactivation of the compressor, or data in a section of the data related to the operation of the refrigeration apparatus corresponding to immediately after operation of the compressor is switched, the refrigeration apparatus is a transporting refrigeration apparatus, the transporting refrigeration apparatus further includes a display or speaker configured to issue a notification of a determination result of whether the compressor has an abnormality or a notification of an estimation result of an abnormality occurrence time, and the display or speaker is configured to issue a notification of a determination result of whether the compressor has an abnormality or a notification of an estimation result of an abnormality occurrence time at least one of when there is a user request, when the transporting refrigeration apparatus or the abnormality determination device is powered on, when transportation of the transporting refrigeration apparatus is completed, or when a pre-trip inspection of the refrigeration apparatus is conducted.

13. A method for determining an abnormality of a compressor of a refrigeration apparatus, the refrigeration apparatus including a refrigerant circuit, and the refrigerant circuit including the compressor, a condenser, and an evaporator and being configured so that a refrigerant circulates through the compressor, the condenser, and the evaporator, the method comprising:

storing data related to operation of the refrigeration apparatus;

calculating a first index value from the data related to operation of the refrigeration apparatus in a first period and calculating a second index value from the data related to operation of the refrigeration apparatus in a second period that differs in length from the first period;

calculating a deviation degree of the compressor from a normal state based on the first index value and the second index value;

determining whether the compressor has an abnormality or estimating an abnormality occurrence time based on the calculated deviation degree of the compressor from the normal state;

calculating the first index value and the second index value from the data related to operation of the refrigeration apparatus and removing from the data related to the operation of the refrigeration apparatus at least one of data in a section of the data related to the operation of the refrigeration apparatus corresponding to the refrigeration apparatus being stopped, data in a section of the data related to the operation of the refrigeration apparatus corresponding to immediately after activation of the compressor, data in a section of the data related to the operation of the refrigeration apparatus corresponding to immediately after deactivation of the compressor, or data in a section of the data related to the operation of the refrigeration apparatus corresponding to immediately after operation of the compressor is switched; and issuing a notification, with a display or speaker, of a determination result of whether the compressor has an abnormality or a notification of an estimation result of an abnormality occurrence time, wherein, the display or speaker issues a notification of a determination result of whether the compressor has an abnormality or a notification of an estimation result of an abnormality occurrence time at least one of when there is a user request, when the refrigeration apparatus or the abnormality determination device is powered on, or when a pre-trip inspection of the refrigeration apparatus is conducted.

14. The refrigeration apparatus according to claim 2, wherein the data related to operation of the refrigeration apparatus in the first period include data for one day, and the data related to operation of the refrigeration apparatus in the second period include data for ten days or more and thirty days or less.

15. The refrigeration apparatus according to claim 2, wherein the processing circuitry is configured to calculate the first index value from a moving average of the data related to operation of the refrigeration apparatus in the first period, and the processing circuitry is configured to calculate the second index value from a moving average of the data related to operation of the refrigeration apparatus in the second period.

16. The refrigeration apparatus according to claim 3, wherein the processing circuitry is configured to calculate the first index value from a moving average of the data related to operation of the refrigeration apparatus in the first period, and the processing circuitry is configured to calculate the second index value from a moving average of the data related to operation of the refrigeration apparatus in the second period.

17. The refrigeration apparatus according to claim 4, wherein the processing circuitry is configured to calculate the first index value from a moving average of the data related to operation of the refrigeration apparatus in the first period, and the processing circuitry is configured to calculate the second index value from a moving average of the data related to operation of the refrigeration apparatus in the second period.

18. The refrigeration apparatus according to claim 1, wherein the at least one sensor includes:

a discharge temperature sensor configured to output a first signal corresponding to a temperature at a discharge port of the compressor, a discharge pressor sensor configured to output a second signal corresponding to a pressor at the discharge port of the compressor, an intake temperature sensor configured to output a third signal corresponding to a temperature at an intake port of the compressor, and an intake pressure sensor configured to output a fourth signal corresponding to a temperature at the intake port of the compressor, wherein the data related to operation of the refrigeration apparatus received from the at least one sensor is based on the first signal, the second signal, the third signal, and the fourth signal.

* * * * *